US006474779B2

(12) United States Patent
Inui et al.

(10) Patent No.: US 6,474,779 B2
(45) Date of Patent: Nov. 5, 2002

(54) INK-JET RECORDING METHOD AND INK-JET RECORDING APPARATUS IN WHICH RECORDING IS PERFORMED BY RECIPROCAL SCANNING

(75) Inventors: Toshiharu Inui; Daigoro Kanematsu; Yoshinori Nakajima, all of Kanagawa; Takumi Kaneko, Tokyo, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/749,729

(22) Filed: Dec. 28, 2000

(65) Prior Publication Data

US 2001/0024218 A1 Sep. 27, 2001

(30) Foreign Application Priority Data

Dec. 28, 1999 (JP) ..... 11-373844
Dec. 28, 1999 (JP) ..... 11-373845

(51) Int. Cl.[7] ..... B41J 2/25
(52) U.S. Cl. ..... 347/43; 347/41; 347/12
(58) Field of Search ..... 347/43, 15, 9, 347/14, 41, 16, 12

(56) References Cited

U.S. PATENT DOCUMENTS 4,533,928 A 8/1985 Sugiura et al. ..... 347/43
5,633,663 A 5/1997 Matsubara et al. ..... 347/41
5,992,972 A 11/1999 Nagoshi et al. ..... 347/43
6,084,604 A * 7/2000 Moriyama et al. ..... 347/15
6,102,520 A * 8/2000 Terasawa ..... 347/43
6,155,663 A * 12/2000 Takayanagi ..... 347/5
6,273,549 B1 * 8/2001 Wetchler et al. ..... 347/43

FOREIGN PATENT DOCUMENTS

| | | |
|---|---|---|
| EP | 0 475 696 A2 | 3/1992 |
| EP | 0 564 252 A2 | 10/1993 |
| EP | 0 589 69 A2 | 3/1994 |
| JP | 58-188662 | 11/1983 |
| JP | 58-191570 | 11/1983 |
| JP | 5-278232 | 10/1993 |
| JP | 6-106736 | 4/1994 |

* cited by examiner

*Primary Examiner*—Lamson Nguyen
(74) *Attorney, Agent, or Firm*—Fitzpatrick, Cella, Harper & Scinto

(57) ABSTRACT

Disclosed are an ink-jet recording method in which scanning is performed with a recording device having a plurality of recording element groups in correspondence with inks of different hues relatively in a direction crossing the direction in which the recording medium is fed to perform recording, the method including the steps of determining the scanning direction according to the duty of the image data in the scanning for recording, and performing recording by performing scanning in the determined scanning direction, and an ink-jet recording apparatus in which scanning is performed with a recording device having a plurality of recording element groups in correspondence with inks of different hues relatively in a direction crossing the direction in which the recording medium is fed to perform recording, including a device for determining the scanning direction according to the duty of the image data in the scanning for recording, and a device for performing recording by performing scanning in the determined scanning direction.

47 Claims, 28 Drawing Sheets

INK-JET RECORDING METHOD AND INK-JET RECORDING APPARATUS IN WHICH RECORDING IS PERFORMED BY RECIPROCAL SCANNING

BACKGROUND OF THE INVENTION

1. Field of the Invention

The present invention relates to an ink-jet recording method, etc. in which images are formed by ejecting a recording liquid such as ink onto a recording medium while scanning recording means.

In particular, the present invention relates to an ink-jet recording method, etc. in which a deterioration in image quality is prevented by reciprocal scanning.

2. Description of the Related Art

Conventionally, an ink-jet recording method for performing recording on various recording mediums is capable of high-density and high-speed recording operation, so that it is applied to a printer, a portable printer or the like as an output medium of various apparatuses, which have become commercial.

Here, the individual recording apparatuses assume constructions in correspondence with the functions, forms of use, etc. peculiar to them.

Generally speaking, an ink-jet recording apparatus is provided with a carriage on which a recording means (recording head) and an ink tank are mounted, a feeding means for feeding the recording medium, and a control means for controlling these components. And, the recording head, which ejects ink droplets from a plurality of ejection holes, caused to perform serial scanning in a direction which crosses, for example, at right angles, the direction in which the recording medium is fed (sub scanning direction), and, when no recording is being performed, the recording medium is intermittently fed by an amount equal to the recording width.

This recording method, in which ink is ejected onto the recording paper in correspondence with a recording signal, is widely used as a recording system which is of low running cost and quiet. Recently, a number of products which use a plurality of inks and applied to color recording apparatuses have been put into practical use.

When the ink-jet recording method is applied to a color recording apparatus, the construction of the recording head can be roughly classified into two types.

One is a recording head in which, as shown in FIG. 14, a number of nozzles ejecting ink are arranged in a line in the sub scanning direction. In the construction shown in FIG. 1A, nozzles 100*y*, 100*m*, 100*c* and 100*k* for ejecting yellow, magenta, cyan and black inks are arranged in a line in the sub scanning direction such that the colors do not overlap each other. In the construction shown in FIG. 1B, a nozzle 101*k* for ejecting black ink is separate from nozzles 101*y*, 101*m* and 101*c* for ejecting color inks. As is apparent from FIG. 14, regarding yellow, magenta and cyan, when so-called secondary colors, blue, red and green are formed to form images of different colors at different positions on the recording medium, the order in which the colors are superimposed on each other is fixed independently of the scanning direction of the recording head. For example, when forming a blue image, recording is first performed in cyan and then recording in magenta is performed thereon. Thus, when the recording head 100 or the recording head 101 is used, no inconsistencies in color are generated if recording is performed through forward scanning and backward scanning.

However, if the number of nozzles for different colors is increased to achieve an increase in speed, the length of the recording head is increased, resulting in an increase in size, or the method of holding the recording medium in the recording portion is complicated, resulting in an increase in the cost of the recording head or the apparatus.

In the second type of construction, recording heads 102*k*, 102*c*, 102*m* and 102*y* for ejecting black ink, cyan ink, magenta ink and yellow ink are arranged in the main scanning direction as shown, for example, in FIG. 2. When this recording head 102 is used, the inks of all colors are ejected in correspondence with image data by one scanning.

Here, when, to achieve an increase in speed, an image is formed by alternately repeating main scanning (in the direction A) and sub scanning (in the direction B), when so-called secondary colors, for example, blue, red and green, are formed, the order in which colors are superimposed on each other differs between the main scanning (in the direction A) and sub scanning (in the direction B), with the result that the color taste (hue) differs between the main and sub scanning, so that inconsistencies in color are generated, resulting in a substantial deterioration in image quality.

In the following, the problems involved when the recording order differs will be specifically described.

To execute full color recording in an ink-jet recording apparatus forming images using inks of four colors, ink droplets of the inks of the four colors are caused to reach the recording medium in appropriate balance, and other colors are generated through mixing. When recording a green (G) image, recording is performed by mixing C and Y. That is, C and Y dots are placed at the same pixel.

FIG. 3 shows the condition of an ink droplet caused to reach ordinary paper by using the head of FIG. 2. FIG. 3A is a sectional view of an ordinary paper sheet at the time of forward recording (C Y), and FIG. 3B is a sectional view thereof at the time of backward recording (Y C). In FIG. 3A, recording is first performed in C to cover the surface, and Y, in which recording is performed afterwards, goes deeper than C.

Conversely, in FIG. 3B, recording is first performed in Y to cover the surface, and C, in which recording is performed afterwards, goes deeper than Y. When seen on the surface, the recording of FIG. 3A appears to be of a green that is rather cyanish, and the recording of FIG. 3B appears to be of a green that is rather yellowish. Thus, if the colors mixed are the same C and Y, the hue completely differs between the forward and backward recordings. As a result, color inconsistency is alternately generated at each line feed.

As described above, the construction of the ink-jet recording head applied to the color recording apparatus is of two types, of the type (the latter) in which the nozzles of the different colors are arranged in the scanning direction is suitable for achieving an increase in the speed of the apparatus. However, this type involves a problem that inconsistency in color is generated due to the difference in the order in which the colors are superimposed on each other between the forward scanning and the backward scanning of the recording head.

To prevent the above-described inconsistency in color in reciprocation, Japanese Unexamined Patent Application Publication No. 5-278232 proposes a system in which, to complete the recording of a predetermined region by a plurality of main scanning operations, thinning-out images are sequentially recorded while sequentially selecting a plurality of thinning-out arrangements in a complementary relationship. Disclosed is a method in which the thinning-out arrangement selected in the same scanning differs between the colors. In this method, however, a so-called multi-pulse recording is performed in which recording is completed by a plurality of main scanning operations, so that the requisite time for complete the recording is rather long.

Further, in Japanese Unexamined Patent Application Publication No. 6-106736, when performing recording while reciprocating the recording head of different colors having a recording density higher than the input image data in the arrangement direction, the recording image is composed of a plurality of pixels (2×2) with respect to one pixel of the input image data, so that, when recording a mixed color image, inks of two or more colors are not superimposed on the 2×2 pixels. However, in this method, the recording resolution is lower than the resolution the recording head originally possesses.

To solve the above problem, Japanese Examined Patent Application Publication No. 3-54508 discloses a method in which the color processing method differs between the forward scanning and the backward scanning of the recording head. However, in this method, two kinds of color processing tables for the forward scanning and backward scanning are necessary.

Further, when performing recording with an ordinary printer, the color processing is conducted in a printer driver on the host computer, the image data after color processing is transferred to the printer main body, and the printer main body processes the received image data in conformity with the recording head. However, when performing the color processing in the printer driver, it is necessary to perform the color processing in a condition in which the way the processed image data is recorded on the main body side is previously known. That is, it is necessary for the host computer to know whether the recording is performed by the forward scanning or the backward scanning of the recording head. This very much complicates the system including the printer driver and the printer main body.

Further, the color reproduction regions (hues) of the forward scanning and the backward scanning are usually deviated, so that, when the color processing is changed so that a common color reproduction region is adopted for the forward scanning and the backward scanning, the color reproduction region is reduced, so that there is a fear of the image quality being deteriorated.

SUMMARY OF THE INVENTION

The present invention has been made in view of the above problems. It is an object of the present invention to achieve a high printing quality and a reduction in recording time as much as possible while preventing a deterioration in quality due to color inconsistency due to reciprocation, thereby achieving a recording shorter than any multi-pass recording or one-pass one-direction recording, making it as close as possible to one-pass reciprocating recording.

Further, the present invention copes with the color inconsistency due to the difference in ejection color order due to the reciprocative recording using a recording head in which nozzles of different colors are arranged in the scanning direction as described above and a reduction in recording speed due to the fact that only one-direction recording is performed; it is an object of the present invention to provide an ink-jet recording method, a recording apparatus, etc. in which, even in the case of a color recording apparatus in which the ink ejection order differs between the forward scanning and backward scanning, it is possible to achieve an improvement in recording speed while reducing color inconsistency.

To achieve the above object, there is provided, in accordance with the present invention, an ink-jet recording method in which scanning is performed with a recording means having a plurality of recording element groups in correspondence with inks of different hues relatively in a direction crossing the direction in which the recording medium is fed to perform recording, wherein the scanning direction is determined according to the duty of the image data in the scanning for recording, the recording being performed by performing scanning in the determined scanning direction.

Alternatively, there is provided an ink-jet recording apparatus in which scanning is performed with a recording means having a plurality of recording element groups in correspondence with inks of different hues relatively in a direction crossing the direction in which the recording medium is fed to perform recording, comprising a means for determining the scanning direction according to the duty of the image data in the scanning for recording, and a means for performing recording by performing scanning in the determined scanning direction.

Alternatively, there is provided an ink-jet recording method which comprises a step for performing scanning a recording means provided with a plurality of recording element groups in correspondence with inks of different hues in a direction in which scanning is performed relatively with respect to the recording medium to perform recording on the recording medium, and a step for feeding the recording medium in a direction crossing the scanning direction, and in which recording is performed according to the scanning direction determined according to the recording duty obtained from a predetermined region of image data corresponding to the scanning region, wherein the determination of the scanning direction is effected according to the duties of at least two regions, i.e., a region positioned in the vicinity of a border portion of the scanning region as the predetermined region, and a region different from this.

Alternatively, there is provided an ink-jet recording apparatus in which a recording means provided with a plurality of recording element groups in correspondence with inks of different hues in a direction in which scanning is performed relatively with respect to the recording medium is scanned to perform recording on the recording medium, and in which recording is performed according to the scanning direction determined according to the recording duty obtained from a predetermined region of image data corresponding to the scanning region, the apparatus comprising a means for feeding the recording medium by a predetermined amount in a direction crossing the scanning direction, and a calculating means for determining the scanning direction according to the duties of at least two regions, i.e., a region positioned in the vicinity of a border portion of the scanning region as the predetermined region, and a region different from this.

Alternatively, there is provided a recording apparatus comprising a control device in which a recording means provided with a plurality of recording element groups in correspondence with inks of different hues in a direction in which scanning is performed relatively with respect to the recording medium is scanned to perform recording on the recording medium, and in which recording is performed according to the scanning direction determined according to the recording duty obtained from a predetermined region of image data corresponding to the scanning region, the apparatus comprising a calculating means for determining the scanning direction according to the duties of at least two regions, i.e., a region positioned in the vicinity of a border portion of the scanning region as the predetermined region, and a transmission means for transmitting information regarding the determined scanning direction to the recording apparatus side.

Alternatively, there is provided a storage medium storing a control command in which a recording means provided with a plurality of recording element groups in correspondence with inks of different hues in a direction in which scanning is performed relatively with respect to the recording medium is scanned to perform recording on the recording medium, and in which recording is performed according to the scanning direction determined according to the recording duty obtained from a predetermined region of image data corresponding to the scanning region, the storage medium comprising a control command for calculating according to the duties of at least two regions, i.e., a region positioned in the vicinity of a border portion of the scanning region as the predetermined region, and a control command for determining the scanning direction according to the recording duties of these plurality of regions.

Alternatively, there is provided a network apparatus storing a control command in which a recording means provided with a plurality of recording element groups in correspondence with inks of different hues in a direction in which scanning is performed relatively with respect to the recording medium is scanned to perform recording on the recording medium, and in which recording is performed according to the scanning direction determined according to the recording duty obtained from a predetermined region of image data corresponding to the scanning region, the network apparatus comprising a control command for calculating according to the duties of at least two regions, i.e., a region positioned in the vicinity of a border portion of the scanning region as the predetermined region, and a control command for determining the scanning direction according to the recording duties of these plurality of regions.

Further objects, features and advantages of the present invention will become apparent from the following description of the preferred embodiments with reference to the attached drawings.

BRIEF DESCRIPTION OF THE DRAWINGS

FIG. 1, which comprises

FIG. 3, which comprises

FIG. 11, which comprises

FIG. 13, which comprises

FIG. 18, which comprises

FIG. 21, which comprises

FIG. 28, which comprises

DESCRIPTION OF THE PREFERRED EMBODIMENTS

Embodiments of the present invention will now be described with reference to the drawings.

In the present invention, the term "recording" does not simply mean imparting a meaningful image such as character or figure to a recording medium but also imparting a meaningless image such as pattern thereto.

Further, in the present invention, as the "recording medium", it is possible to use not only paper but also thread, fiber, cloth, leather, metal, OHP sheet, plastic, glass, wood, ceramic, etc.

Further, the recording apparatus of the present invention implies a printer, a printer portion used in a printer, a typewriter, a copying machine, a recording system combining a facsimile machine having a communication system or a communication system with a printer portion, an apparatus such as a word processor having a printer portion, and a work station or the like in which various processing apparatuses are combined with an industrial recording apparatus.

Further, it also implies a handy or portable printer provided in a personal computer, a host computer, an optical disk apparatus, a video apparatus or the like.

Figure 5:
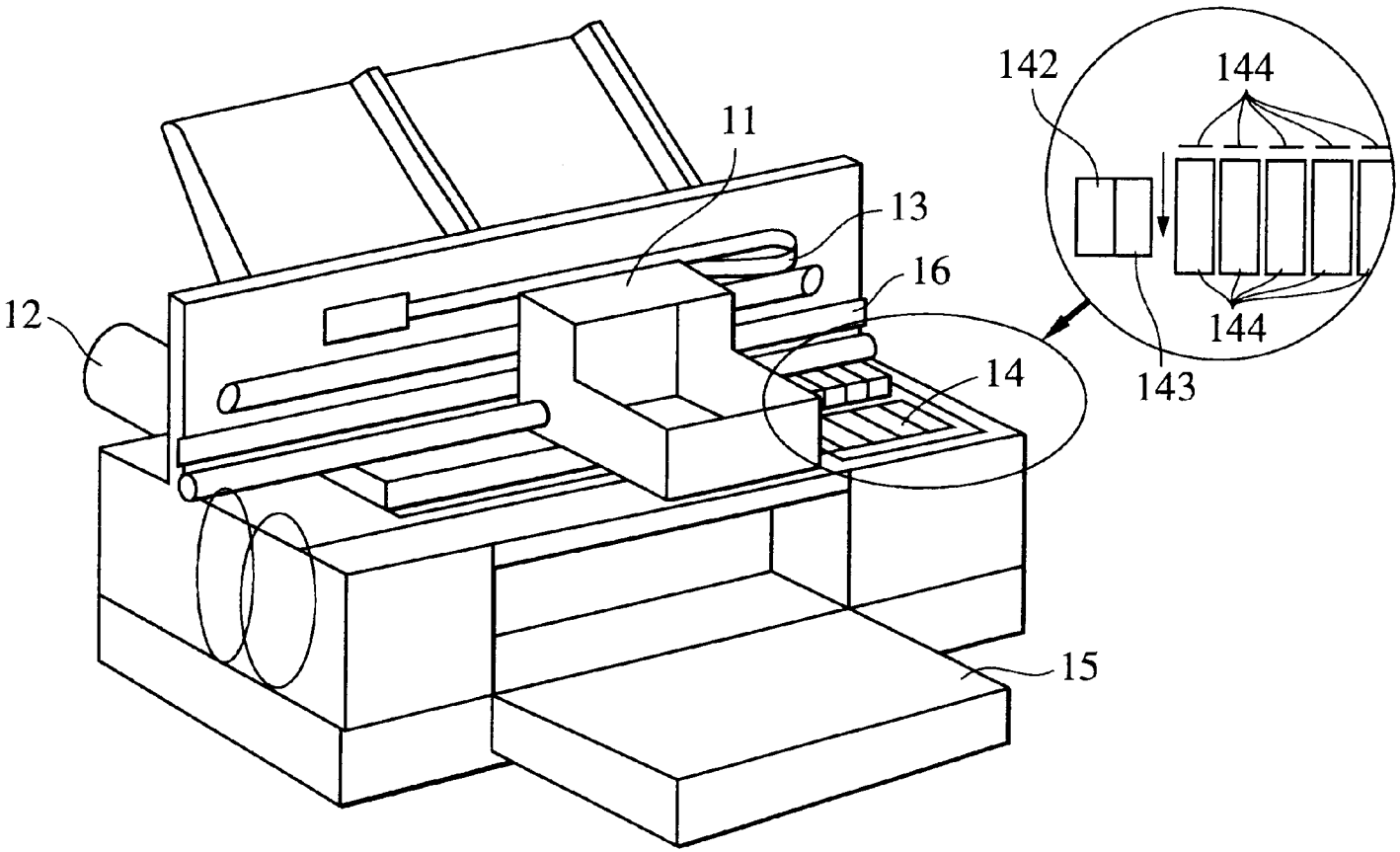
FIG. 5 is a schematic diagram illustrating the construction of the recording apparatus of the present invention.

First, FIG. 5 shows an outward appearance of the ink-jet recording apparatus used in this embodiment.

The ink-jet recording apparatus comprises a carriage 11 on which a cartridge is mounted, a carriage motor 12 which causes the carriage to move in the main scanning direction relative to the recording medium, a flexible cable 13 for transmitting an electric signal from a control portion (not shown) of the ink-jet apparatus to an ink-jet cartridge, a recovery means 14 for performing a recovery processing on the ink-jet head unit, a paper feeding tray 15 for storing recording mediums in a stacked state, an optical position sensor 16 for optically reading the carriage position, etc. In the ink-jet apparatus, constructed as described above, the carriage 11 is caused to perform serial scanning to perform recording in a width corresponding to the ejection holes of the ink-jet head (number of nozzles), and, when no recording is being performed, the recording medium is fed intermittently by a predetermined amount in a direction crossing (in this case, perpendicular to) the main scanning direction.

Further, in the drawing, which is an enlarged view of a portion of the means 14, numeral 141 indicates a suction and letting-alone cap, numeral 142 indicates an ejection reception portion for receiving the processing liquid ejected at the time of ejection recovery, numeral 143 indicates an ejection reception portion for receiving the ink ejected at the time of ejection recovery, and numeral 144 indicates a wiper blade for wiping the face surface, which performs wiping on the face surface while moving in the direction of the arrow.

Figure 6:
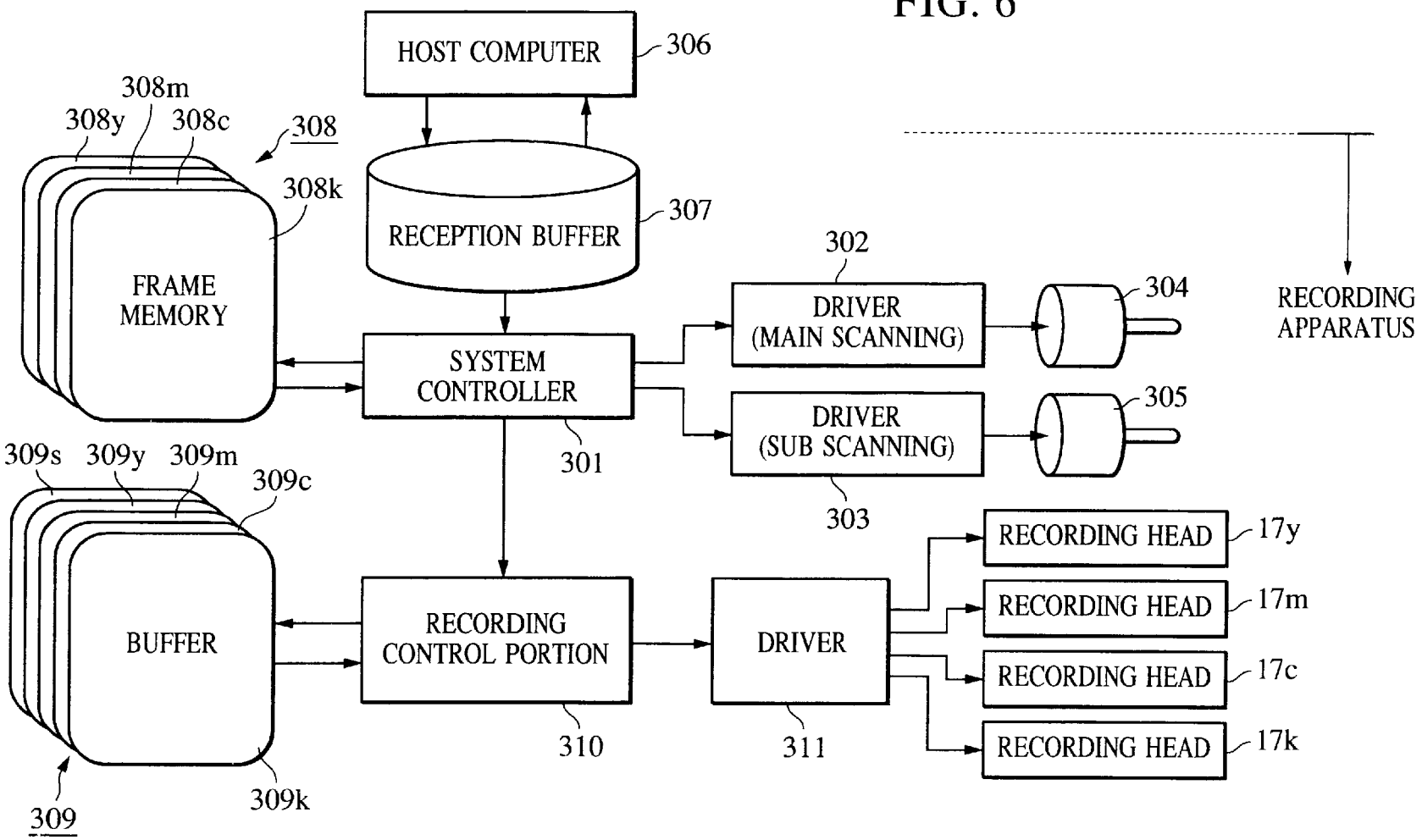
FIG. 6 is a schematic block diagram of the ink-jet recording apparatus of the present invention.

FIG. 6 is a block diagram showing a construction example of the electrical control system of the ink-jet recording apparatus shown in FIG. 5.

Numeral 301 indicates a system controller for controlling the entire apparatus, in which there are arranged a microprocessor, a storage element (ROM) as a storage medium accommodating the control program, etc. Numeral 302 indicates a driver for driving the recording head in the main scanning direction. Numerals 304 and 305 indicate motors respectively corresponding to the drivers 302 and 303; they operate upon receiving information such as speed and movement distance from the drivers.

Numeral 306 indicates a host computer, which is an apparatus having a transmission means for transferring information or the like to be recorded to the recording apparatus of the present invention. It may assume the form of a computer as an information processing device or an image reader.

Numeral 307 indicates a buffer for temporarily storing the data from the host computer 306; it stores the reception data until the reading of the data from the system controller is performed.

Numeral 308 (308*k*, 308*c*, 308*m*, 308*k*) indicates a frame memory for developing the data to be recorded in image data, which has a requisite memory size for recording for each color. Here, while a frame memory capable of recording a sheet of recording paper is described, it goes without saying that the present invention is not restricted to a fixed frame memory size. Numeral 309 (309*k*, 309*c*, 309*m*, 309*y*) indicates a storage element for temporarily recording the data to be recorded; its storage capacity varies according the number of nozzles of the recording head.

Numeral 310 indicates a recording control portion for appropriately controlling the recording head according to a command from the system controller 301; it control the recording speed, the number of items of recording data, etc. Numeral 311 indicates a driver for driving recording heads 17*k*, 17*c*, 17*m* and 17*y* for ejecting inks; it is controlled by a signal from the recording control portion 310.

In the construction described above, the image data supplied from the host computer 306 is transferred to the reception buffer 307 and temporarily stored there before it is developed in the frame memory for each color. Next, the developed image data is read by the system controller 301 and developed in the buffer 309. The recording control portion 310 controls the operation of the recording heads 17*k*, 17*c*, 17*m* and 17*y* on the basis of the image data in each buffer, the processing liquid, etc.

First Embodiment

Figure 7:
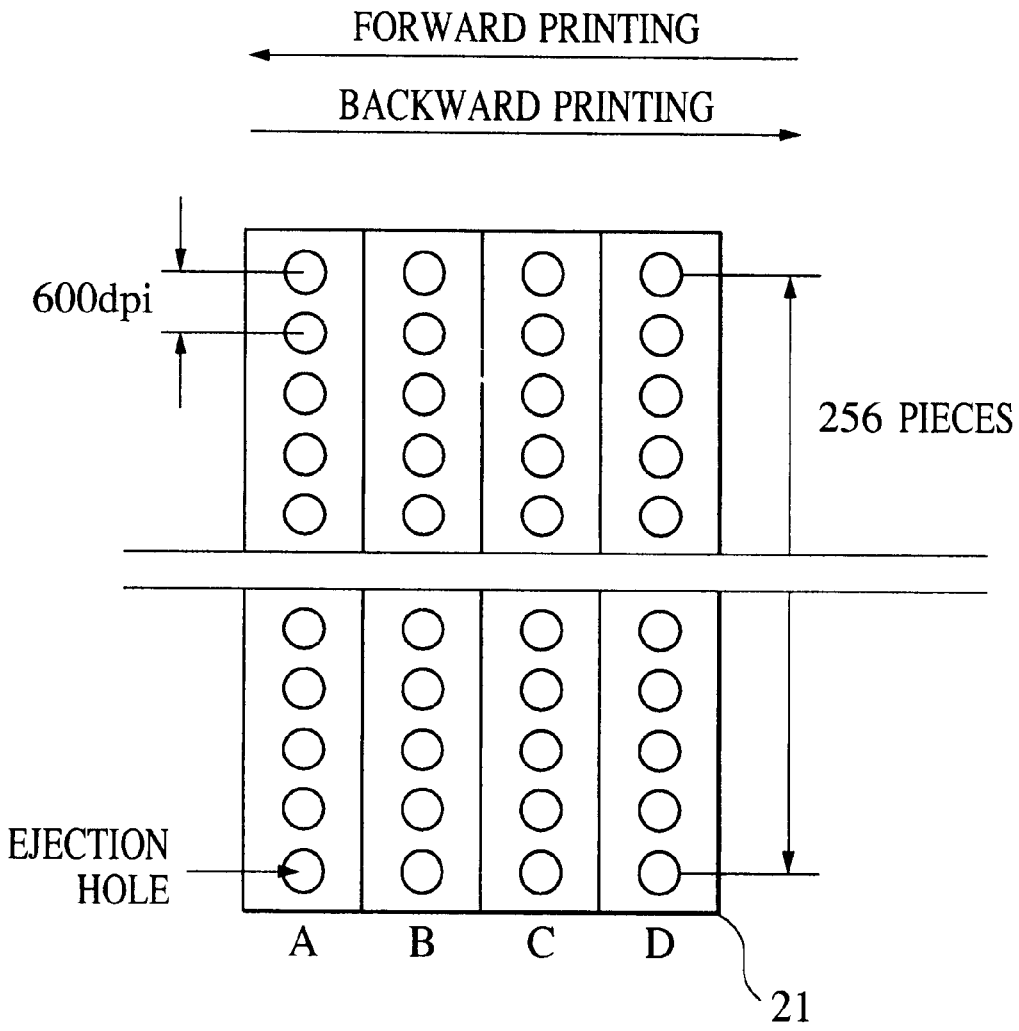
FIG. 7 is a schematic diagram of a head according to embodiment 1.

FIG. 7 shows the recording head used in the present invention. K is ejected from the tip A, C is ejected from the tip B, M is ejected from the tip C, and Y is ejected from the tip D. The amount of ink drop ejected from each nozzle is 17 ng.

The nozzles are of 600 dpi pitches, and 256 nozzles are arranged. It is possible to record dots at 600 dpi pixel positions while scanning in the main scanning direction (the direction indicated by the arrow).

Figure 1A:
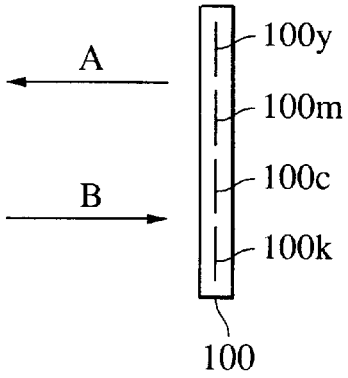
FIGS. 1A and 1B, is a schematic diagram of an ink-jet recording apparatus according to an embodiment of the present invention.
Figure 1B:
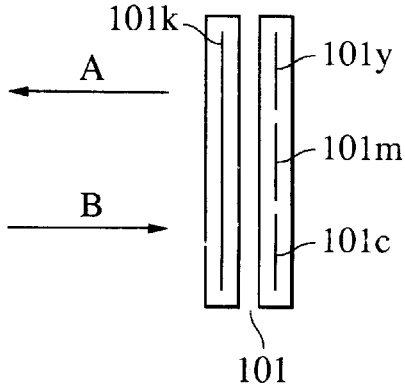
Figure 2:
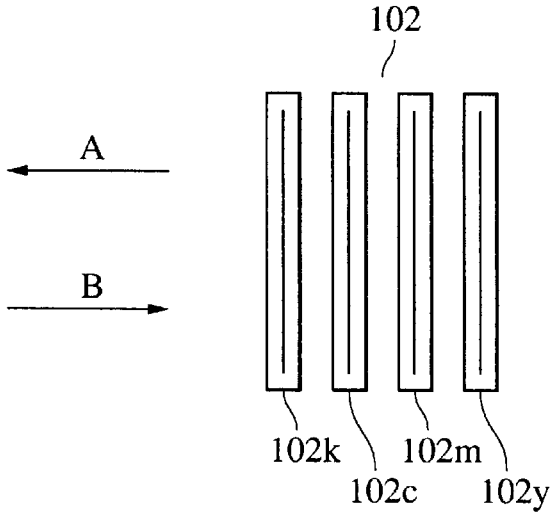
FIG. 2 is a schematic diagram of a head according to an embodiment of the present invention.

As described above, in the present invention, the recording means has recording element groups ejecting inks of four different hues, K, C, M and Y. In FIG. 2, only the nozzle (ejection hole) of the portions forming the recording means is shown. Though not shown, there are arranged, in correspondence with these ejection holes, ink flow passages for conveying ink to the ejection positions, heat generating elements such as electro-thermal converters generating energy for ejecting ink, piezoelectric elements, etc. as components constituting the recording means.

Further, the driving frequency of the head is 10 KHz, and the moving speed of the carriage is 16.7 inch/sec while recording is performed and 29.7 inch/sec while no recording is performed.

Figure 8:
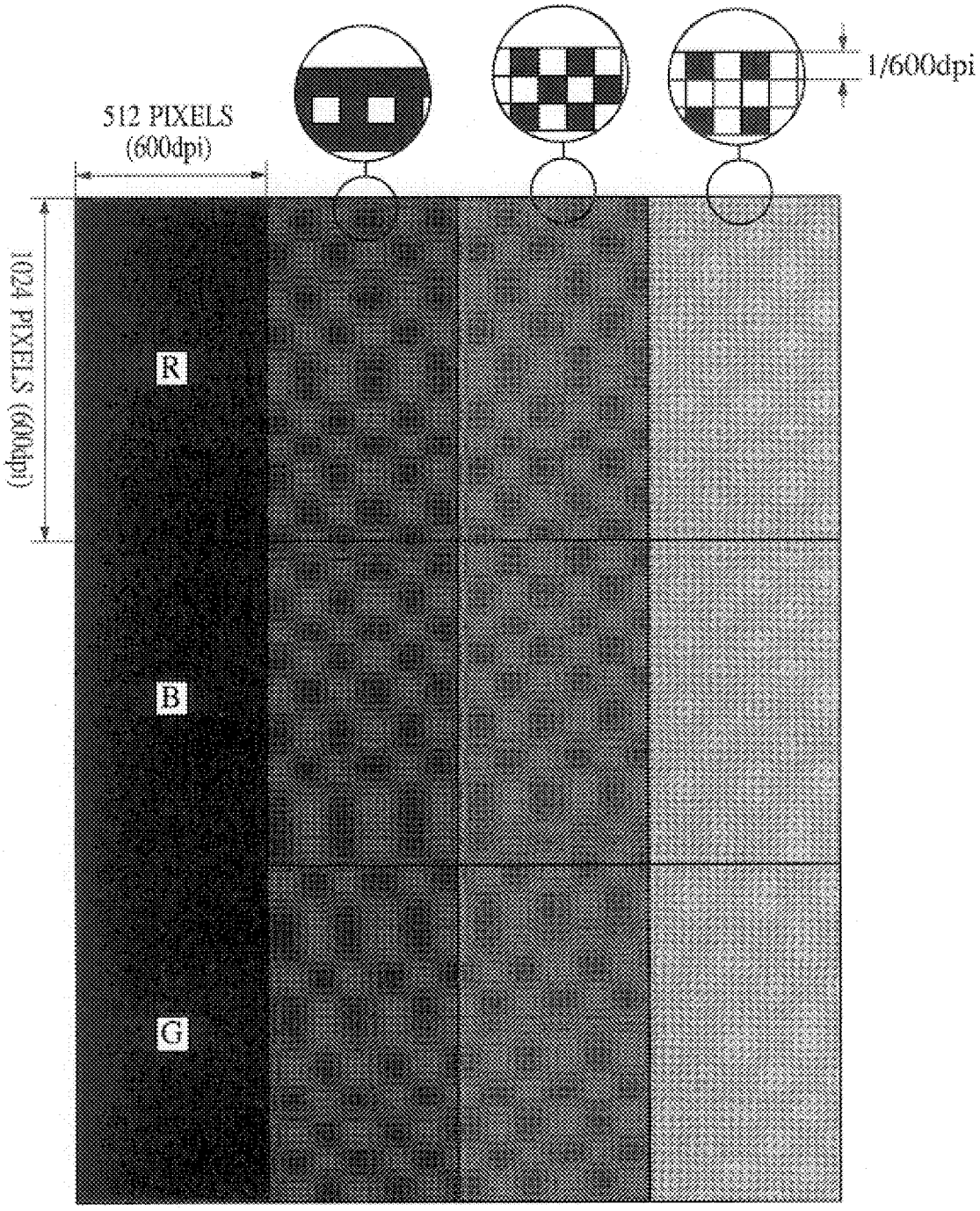
FIG. 8 is a diagram showing a recording pattern used in the embodiment.

FIG. 8 shows a pattern used to determine the dot threshold value for designating the recording direction in this embodiment. The first stage is for red (R), the second stage is for blue (B), and the third stage is for green (G), patches being laterally arranged for first row recording duty of 100%, second row recording duty of 75%, third row recording duty of 50%, and fourth row recording duty of 25%. The black portion in the enlarged circle is the recording pixel, the region R recording M and Y in the pixel, the region B recording C and M, and the region G recording C and Y.

The size is as follows: longitudinally 1024 pixels×laterally 512 pixels (600 dpi).

Figure 9:
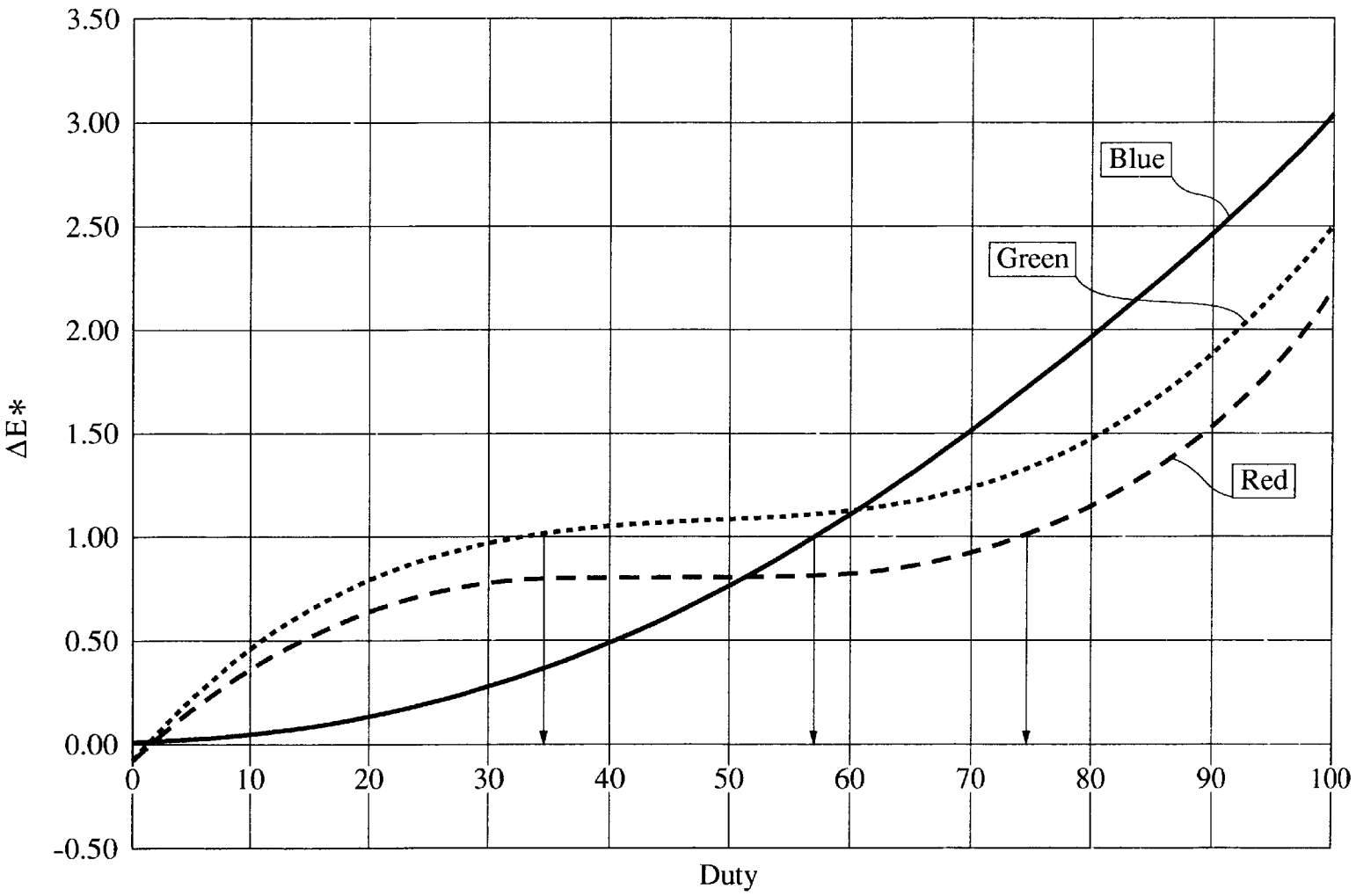
FIG. 9 is a diagram showing the dependence of chrominance on recording duty.

The image is recorded on ordinary paper through one-pass reciprocation by using the head of FIG. 7. After this, color measurement is performed on the forwardly recorded portion and the backward recorded portion. The L*a*b* in each patch reciprocation was obtained, and the chrominance in the space ($\Delta E^* = \sqrt{(\Delta L^* \times \Delta L^* + \Delta a^* \times \Delta a^* + \Delta b^* \times \Delta b^*)}$) was calculated. The result is shown in FIG. 9.

In all of R, B and G, the higher the recording duty, the larger the chrominance.

Further, it is generally said that the level at which chrominance can be perceived in adjacent images is approximately 1.0, so that it is to be assumed that it is substantially possible to prevent a deterioration in image quality due to color inconsistency due to reciprocating recording regarding all the colors of R, G and B if the recording duty is approximately 50% or less. Thus, in this embodiment, a description will be given on the assumption that the dot threshold value is 50%. However, the threshold value, which is to be set according to the requisite image quality, recording speed, etc., is not restricted to this value.

Embodiment 1-1

Figure 10:
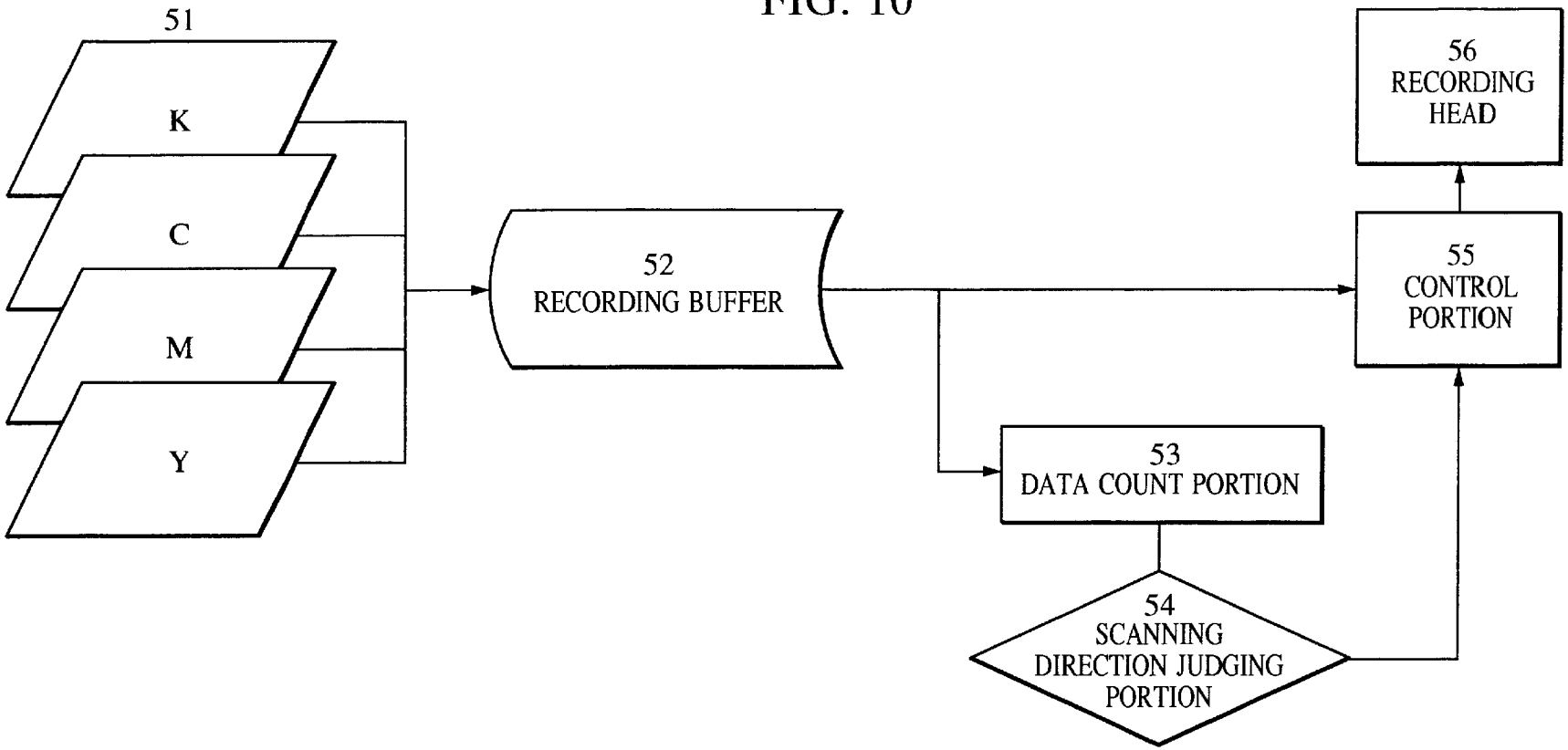
FIG. 10 is a block diagram of embodiments 1-1 and 1-2.

FIG. 10 is a block diagram showing the ink jet recording method used in the present invention. Numeral 51 indicates recording data of each color (K, C, M, Y), numeral 52 indicates recording buffer of each color, numeral 53 indicates a data count portion for counting the data number of C, M, Y of 52 while shifting the windows of n pixels×n pixels, numeral 54 indicates a recording direction judging portion for comparing the data value counted by the data count means with a predetermined value to designate the next recording direction, numeral 55 indicates a control portion for performing recording on the basis of information from the recording direction judging portion 54, and numeral 56 indicates a recording head controlled by the control portion.

The actual recording operation will now be described.

In this embodiment, the size of the window for dot counting the duty at 53 is 64 dots×64 dots. However, the window size may be changed as needed taking into account the calculation load at the time of counting. From the above, the threshold value is 2048, which is 50% of the number of pixels.

Figure 11A:
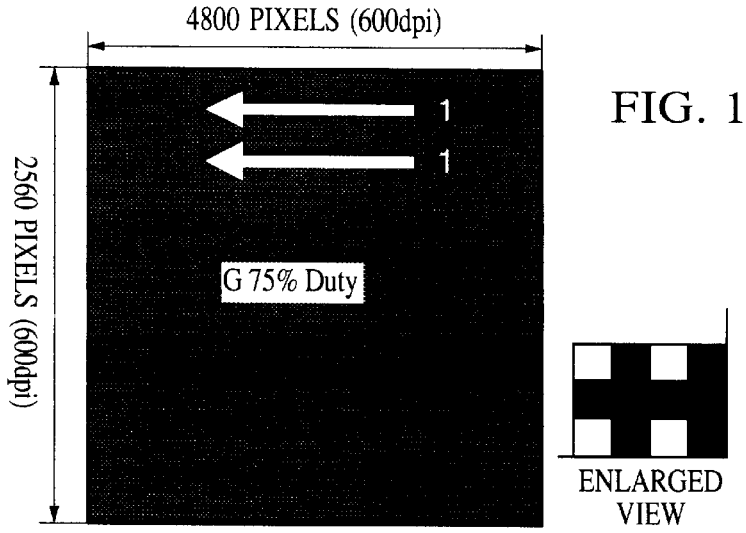
FIGS. 11A, 11B and 11C, is a diagram showing a recording pattern used in embodiments 1-1 and 1-3.
Figure 11B:
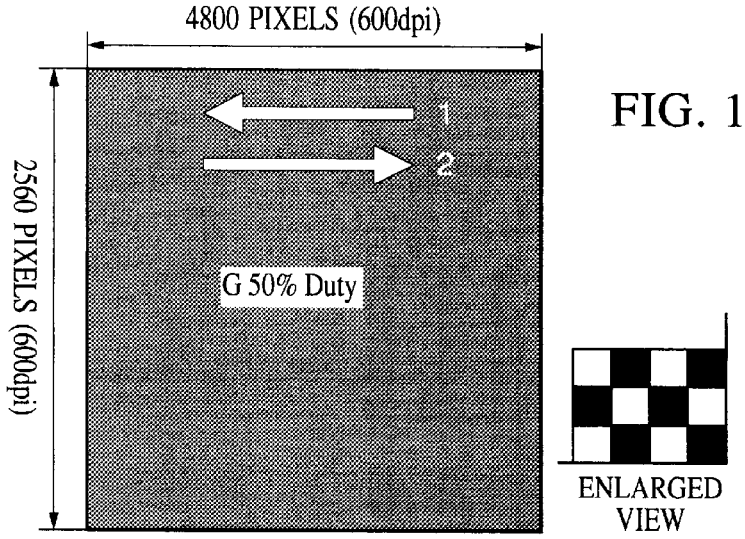
Figure 11C:
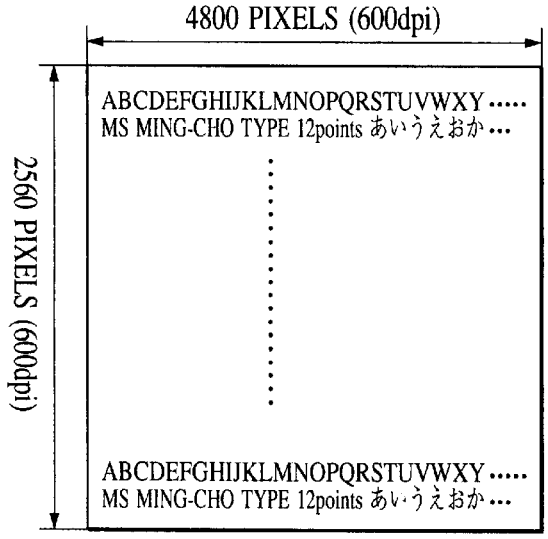

FIG. 11 shows the recording pattern used. Here, the recording color used is all G. In FIG. 11A, characters are given in 75% duty patch of laterally 4800 pixels× longitudinally 2560 pixels, in FIG. 11B, characters are given in 50% duty patch of laterally 4800 pixels×longitudinally 2560 pixels, and in FIG. 11C, characters are given in a range of laterally 4800 pixels×longitudinally 2560 pixels. (In the enlarged view, the black portion is the recording pixel, C and Y being recorded with respect to the pixel.)

Figure 12:
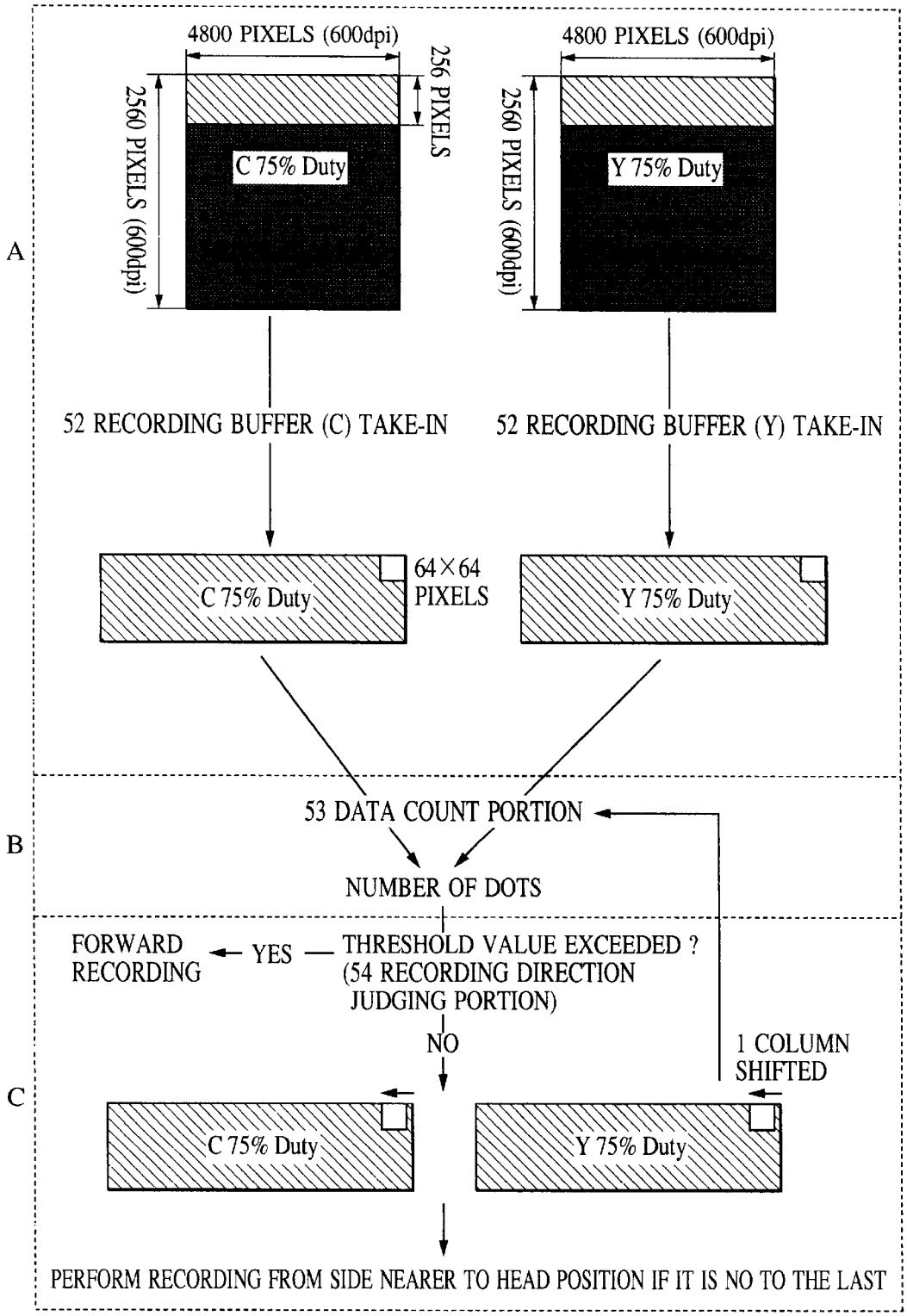
FIG. 12 is an overall flowchart of embodiment 1-1.

Next, the operation when recording the pattern of FIG. 11A will be described in detail with reference to FIG. 12.

After the data input of FIG. 11A, one scanning data (longitudinally 256×laterally 4800) is taken in the C and Y of the recording buffer 52 (region A). Next, the data number of the 64 dots×64 dots region where the C data and Y data of the recording buffer 52 is given is counted by the data cunt portion 53 (region B). The data count value is compared with threshold value (2048 in this case) the recording direction judging portion 54.

Here, the duty is 75%, which exceeds the threshold value of 50%, so that the scanning direction is designated to the forward direction (the direction of the arrow 1 in FIG. 11A, recording being performed in the order: K, C, M, Y (region C). On the basis of this designation, recording is performed by the recording head 56. Subsequently, the paper is fed in the sub scanning direction by 256 pixels, and the second scanning is recorded by the same process as described above. In the scanning from the second scanning onward also, the duty is 75%, which exceeds the threshold value of 50%, so that the recording is all performed in the forward direction (arrow 1 of FIG. 11A) as one-pass one direction recording, no color inconsistency being generated between the scanning operations.

Next, in the case of the recording of FIG. 11B also, it is executed in the same manner as in FIG. 11A. However, in the case of FIG. 11B, the dot count value is smaller than the threshold value, so that the color inconsistency between the scanning operations is not conspicuous. Thus, in order to achieve an improvement in terms of recording speed, recording is performed from the side where the head is positioned after the completion of the scanning of the previous recording. Thus, in the first scanning, the recording is performed in the forward direction (direction 1, recording being performed in the order: K, C, M, Y). However, in the second scanning, the recording is performed in the backward direction (direction 2, the recording being performed in the order: Y, M, C, K).

As a result, one-pass reciprocating recording is performed, and the recording time can be reduced as compared with the one direction recording. Further, there is no color inconsistency, making it possible to output at high speed a high quality image.

Further, in the case of the recording of FIG. 11C also, the dot count value is smaller than the dot count value as in the case of FIG. 11B, so that recording is always performed from the side nearer to the head after the completion of the scanning, so that the recording is performed in the forward direction in the first scanning, but it is performed in the backward direction in the second scanning. As a result, one-pass reciprocating recording is performed, making it possible to reduce the recording time as compared with the one direction recording. Further, there is no conspicuous color inconsistency, making it possible to output at high speed a high quality image.

Further, a similar result was obtained regarding red and blue.

While in the above embodiment the recording direction is varied according to the dot number of each color, it is also possible to vary the recording direction solely on the basis of the dot number of yellow. Since it is yellow only, there is an advantage that it can be realized relatively easily as compared with the above embodiment.

While in the above description the level at which chrominance can be perceived is approximately 1.0, if the chrominance is the same, color inconsistency is relatively conspicuous in the case of R and G, and less conspicuous in the case of B. Thus, in the case in which the chrominance at maximum input is the same for R, G and B, an improvement in image quality can be achieved by mitigating the color inconsistency for R and G. In view of this, it is effective to some extent to control the recording direction focusing attention on yellow, which is common to R and G.

Further, the effect is more remarkable when the chrominance at the time of maximum input is approximately 2.

Embodiment 1-2

Figure 13A:
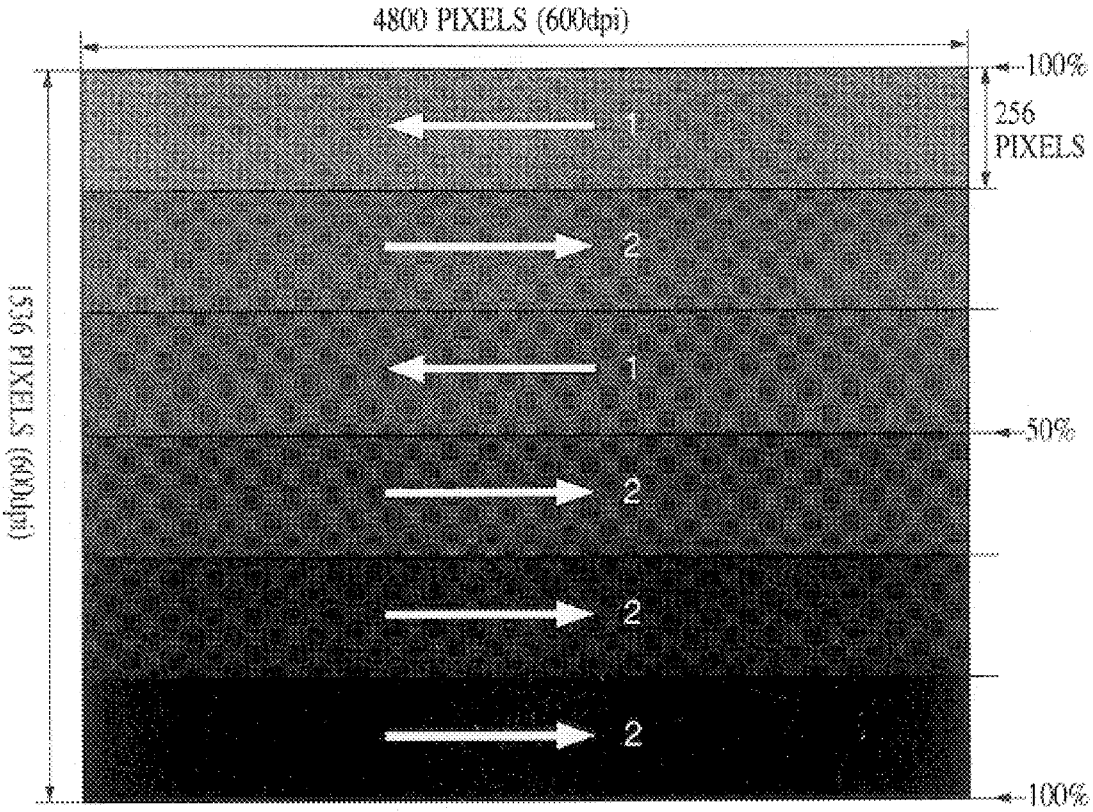
FIGS. 13A and 13B, is a diagram shown a recording pattern used in embodiments 1-2 and 1-4.

FIG. 13 shows the recording pattern used in this embodiment. As in embodiment 1-1, it is a pattern of G only. FIG. 13A shows the case in which recording of laterally 4800 pixels×longitudinally 1536 pixels is performed. There is a gradation in the longitudinal direction of the image, extending from the white in the uppermost stage to the G 100% of the lowermost stage.

Figure 13B:
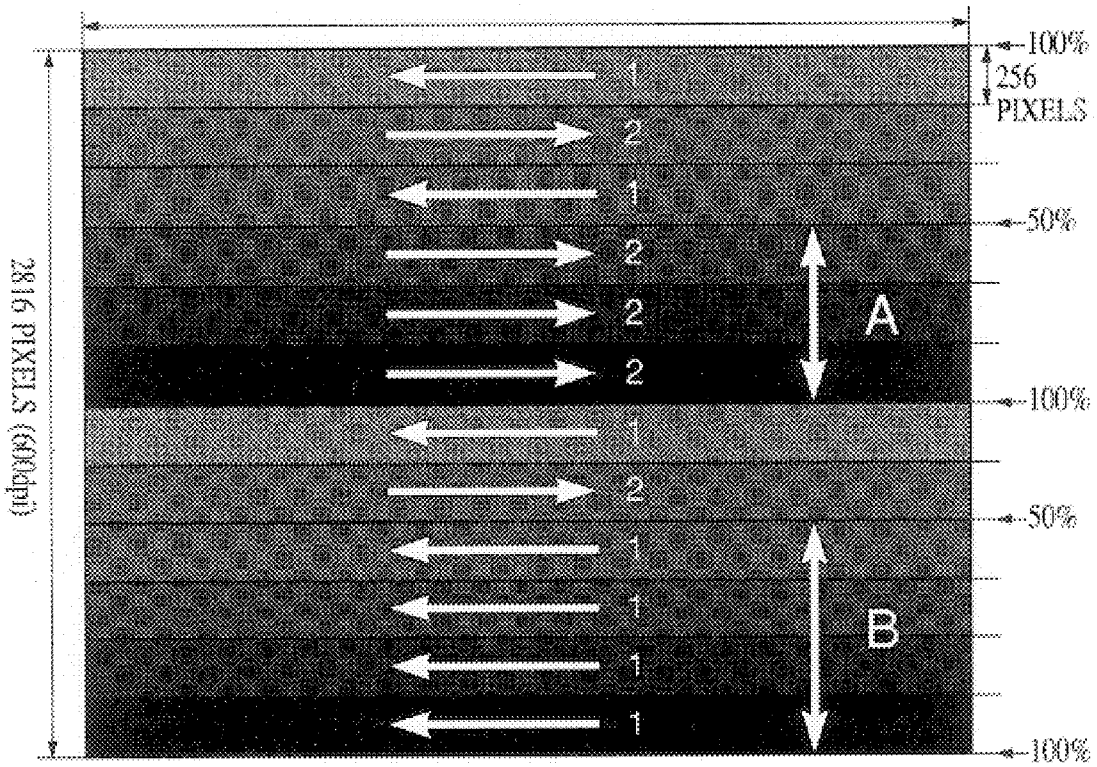

FIG. 13B shows the case in which recording is performed in laterally 4800 pixels×longitudinally 2816 pixels. There is a gradation in the longitudinal direction of the image. The uppermost stage is white, and, in the middle, G 100% is to be perceived, and further, from the stage where G is 25%, the lowermost, G 100% stage is to be perceived. The idea of recording duty is the same as that in the first embodiment.

Figure 14:
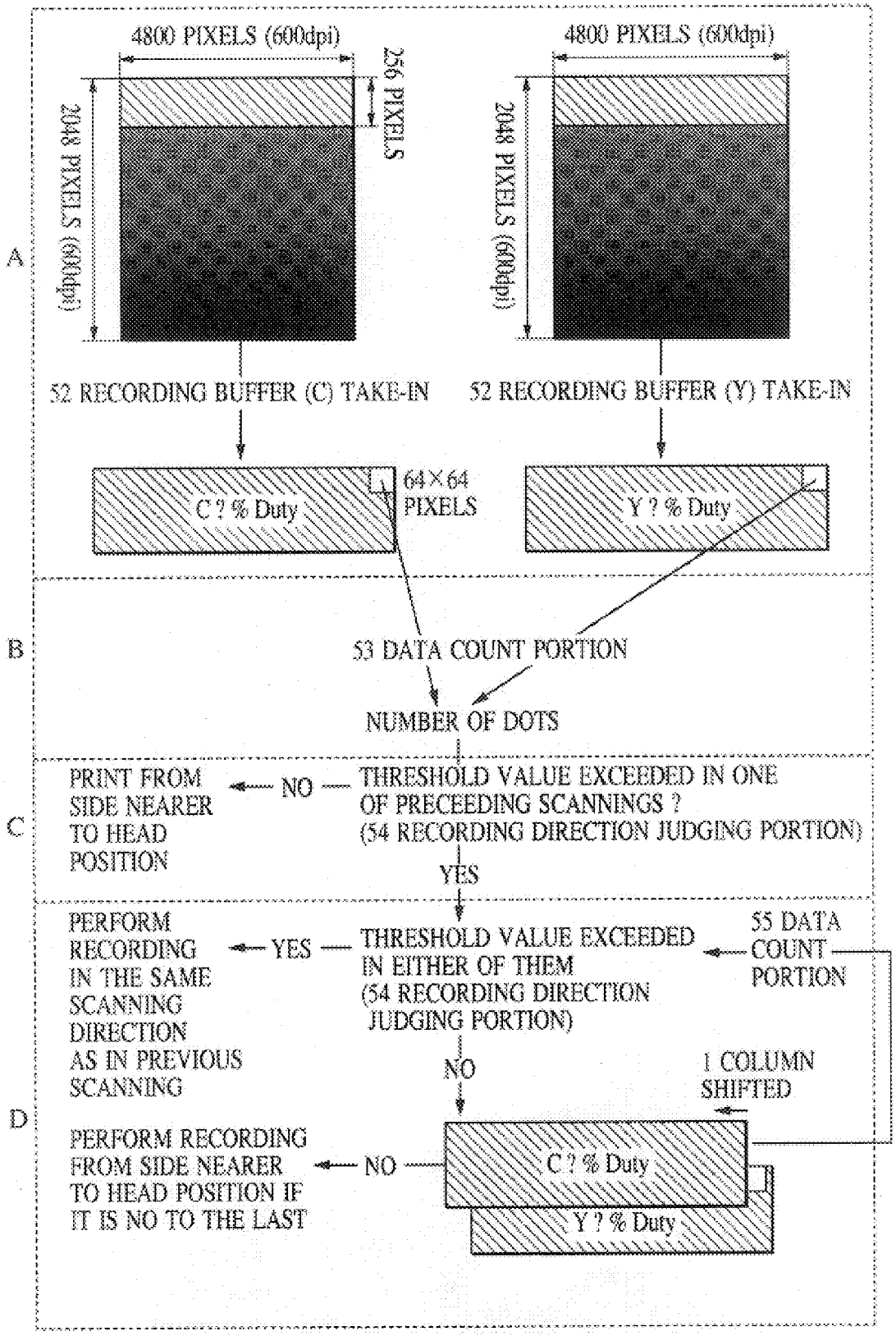
FIG. 14 is an overall flowchart of embodiment 1-2.

Next, the operation when recording the pattern of FIG. 13A will be described in detail with reference to FIG. 14.

After the data input, one scanning data (longitudinally 256 dots×laterally 4800 dots) is taken in the C and Y of the recording buffer 52 (region A). Next, the data number of the 64 dots×64 dots region where the C data and the Y data of the recording buffer 52 is shown is counted by the data count portion 53 (region B).

A judgment is then made as to whether the previous scanning has exceeded the threshold value or not on the basis of the storage data of the recording direction judging portion 54. When it has not been exceeded, recording is performed starting from the data nearer to the head position after the previous scanning (region C). However, when the previous scanning has exceeded the threshold value, the dot number of the scanning is compared with the threshold value; when the threshold value is exceeded, recording is executed in the same direction as in the previous scanning. When it has not been exceeded, the data count region is shifted, and the dot number is again compared with the threshold value (region D). When it is not exceeded to the last, recording is performed from the side nearer to the head position.

As a result of thus performing recording, recording was performed in the scanning direction shown in FIG. 13A. Direction 1 is the forward direction (in the order of K, C, M, Y), and direction 2 is the backward direction (in the order of Y, M, C, K).

As a result, by further restricting the condition as compared with the first embodiment, the number of times that the reciprocating recording is performed increases, making it possible to perform recording at higher speed. However, when the image as shown in FIG. 13B is recorded, the regions are not adjacent to each other, so that it is not conspicuous enough. However, the hue is different from portions A and B. and the quality is somewhat deteriorated as compared with the recording by the method of the first embodiment.

While the case of G has been described, the same result can be obtained in the case of R and B.

Embodiment 1-3

Figure 15:
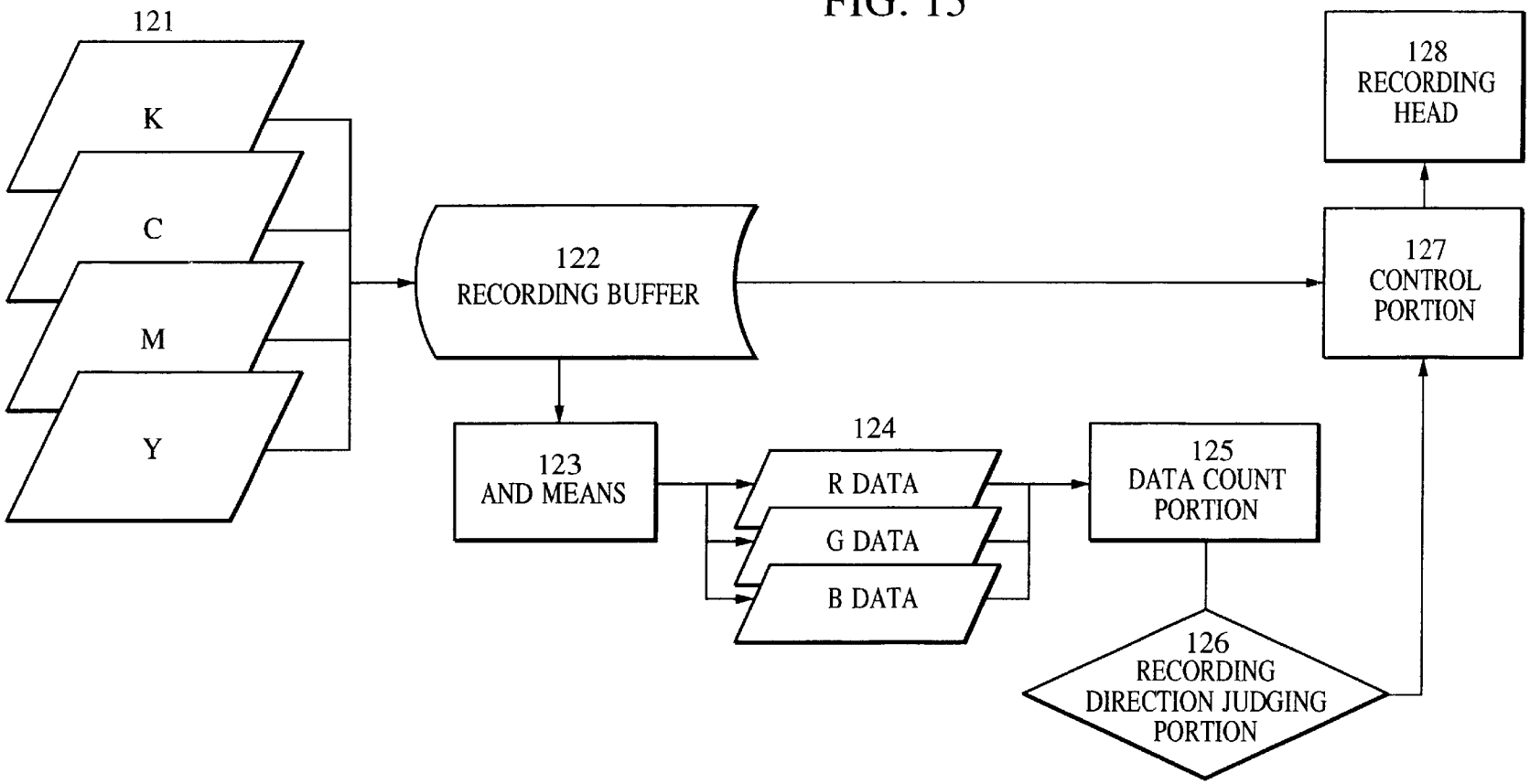
FIG. 15 is a block diagram of embodiments 1-3 and 1-4.

FIG. 15 is a block diagram of the ink-jet recording apparatus used in the present invention. Numeral 121 indicates recording data of each color (K, C, M, Y), numeral 122 indicates a recording buffer of each color, numeral 123 indicates an AND means for AND-ing the C and M, C and Y, and M and Y data in the recording buffer 122, numeral 124 indicates a data buffer means for storing the AND-ed data (B for C and M, G for C and Y, and R for M and Y), numeral 125 indicates a data count means for counting the data number of the data buffer means 124 while shifting the n pixels×n pixels window, numeral 126 indicates a recording direction judging portion for comparing the data value counted by the data count means with a predetermined value to designate the next recording direction, numeral 127 indicates a control portion for executing recording on the basis of information from the recording direction judging portion, and numeral 128 indicates a recording head controlled by the control portion 127.

In this embodiment, to further enhance the color inconsistency restraining effect than in the embodiments 1-1 and 1-2, there is provided a method for controlling the recording direction on the basis of the secondary colors where color inconsistency is involved.

In this embodiment also, the dot threshold value is common for R, G and B. However, to effect the setting more accurately, it is also possible to give separate threshold values for R, G and B, the duty where chrominance is not to be perceived being different for R, G and B as shown in FIG. 9. Optimum values are as follows: R=75%, G=35%, and B=55%.

The actual recording operation will now be described. In this embodiment, the size of the window where dot counting is performed at 125 is 64 dots×64 dots. From the above, the threshold value is 2048, which is 50% of the pixel number. The pattern used, shown in FIG. 8, is the same as that of the first embodiment.

Figure 16:
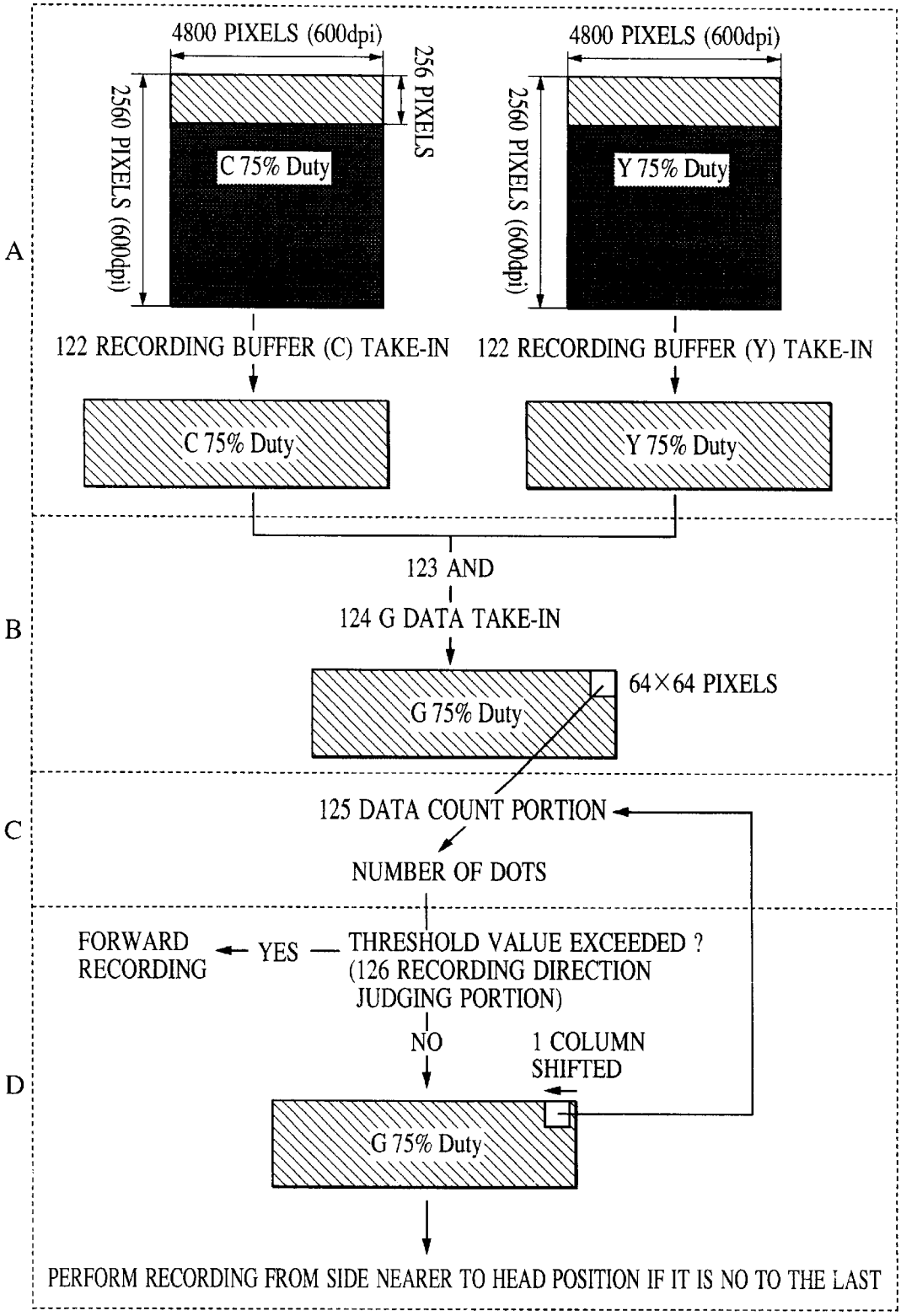
FIG. 16 is an overall flowchart of embodiment 1-3.

Next, the operation at the time of pattern recording in (a) will be described in detail with reference to FIG. 16.

After the data input in (a), one scanning data (longitudinally 256×laterally 4800) is taken in the C and Y of the recording buffer 122 (region A). Next, the C and Y data is ANDed by the AND means 123, and the data is stored in the G data storage portion 124 (region B). And, in the data count portion 125, the data number of the 64×64 region where the G data of the G data storage portion 124 is shown is counted by the data count portion 125 (region C).

The data count value is compared with the threshold value (which is 2048 in this case) that the recording direction judging portion 126 has. Since the threshold value is exceeded, the scanning direction is designated to the forward direction (the direction of the arrow 1 in FIG. 11A) (region D). On the basis of the designation, recording is executed by the recording head 58. Subsequently, the paper is fed in the sub scanning direction by an amount corresponding to 256 pixels, and the second pass recording is effected in the same manner as described above. As a result, the recording is all one-pass one-direction recording from the forward direction (direction 1 of FIG. 11A), with no color inconsistency being generated.

Next, the recording of (b) is executed in the same manner as in the case of (a). In the case of (b), the dot count value is smaller than the threshold value, so that recording is also performed from the side nearer to the head position after the completion of the scanning. Thus, while recording is performed in the forward direction for the first scanning, the recording for the second scanning is effected in the backward direction. As a result, one-pass reciprocating recording is effected, and the recording time can be reduced as compared with that in the one-pass one-direction recording. Further, no color inconsistency is involved, making it possible to output at high speed images of high quality.

Further, in the case of (c) also, the dot count value is smaller than the threshold value, so that recording is always performed from the side nearer to the head after the completion of the scanning. Thus, while the recording of first scanning is effected in the forward direction, the recording of second scanning is effected in the backward direction. As a result, one-pass reciprocating recording is conducted, and the recording time can be reduced as compared with that of the one-pass one-direction recording. Further, no color inconsistency is involved, making it possible to output at high speed images of high quality.

In this embodiment also, similar results were obtained regarding R and B.

Embodiment 1-4

FIG. 13 shows the pattern used in this embodiment. (It is the same as the pattern used in the second embodiment.)

Figure 17:
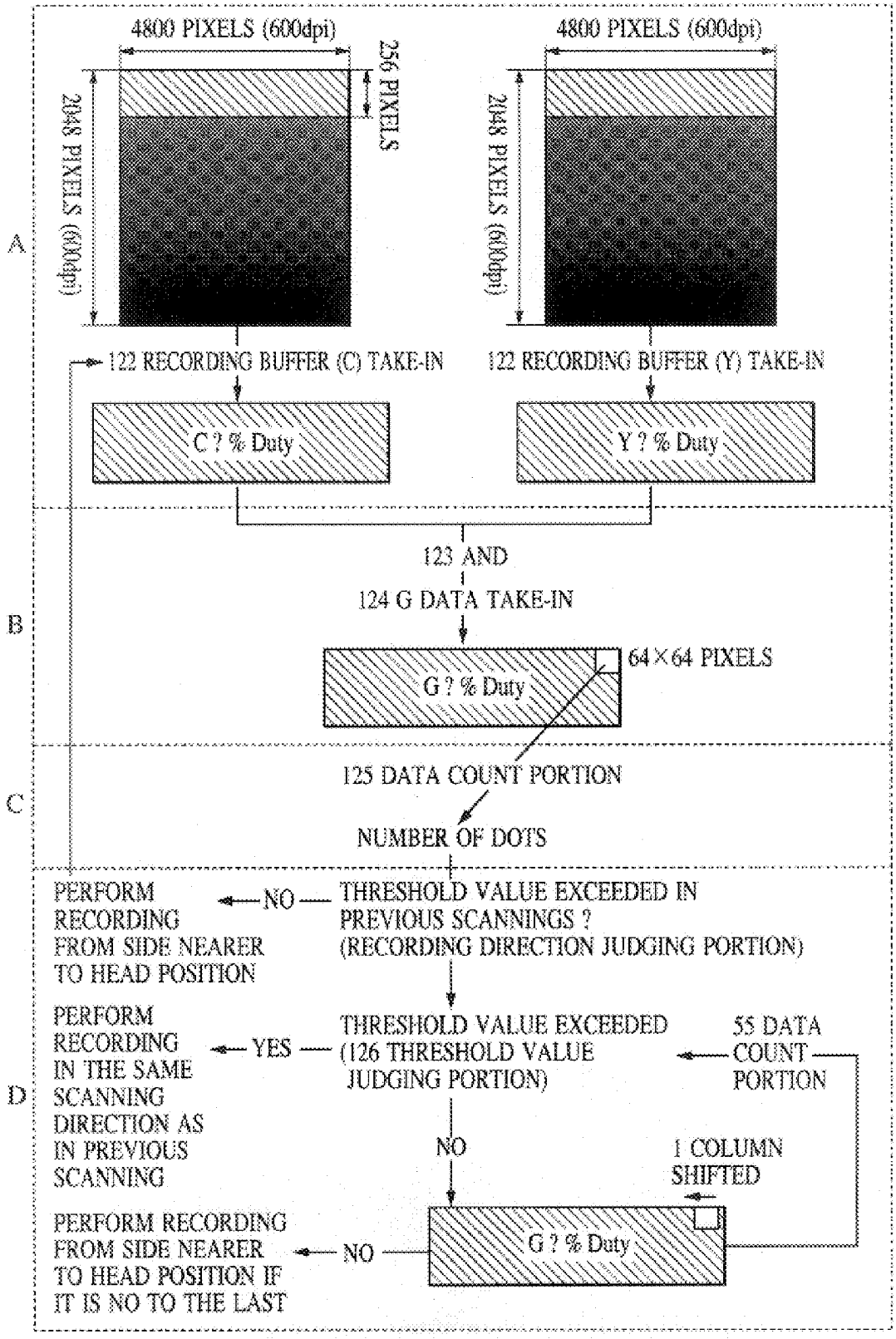
FIG. 17 is an overall flowchart of embodiment 1-4.

Next, the operation at the time of the pattern recording of FIG. 13A will be described in detail with reference to FIG. 17. After the data input, one scanning data (longitudinally 256×laterally 4800) is taken in the C and Y of the recording buffer 122 (region A). Next, the C and Y data is ANDed by the AND means 123, and the data is stored in the G data storage portion 124 (region B). And, in the data count portion 125, the data number of the 64×64 dot region where 54 G data is shown is counted (region C).

Then, a judgment is made as to whether the threshold value is exceeded in the previous scanning direction or not on the basis of the storage data of the recording direction judging portion 126. When it is not exceeded, recording of the scanning is performed starting from the data nearer to the head position. However, when the threshold value has been exceeded in the previous scanning, the dot number of the scanning is compared with the threshold value, and when the threshold value is exceeded, recording is executed in the same direction as in the previous scanning. When it has not been exceeded, the data count region is shifted, and the dot number is again compared with the threshold value. When it is not exceeded to the last, recording is performed from the side nearer to the head position (region D).

As a result of executing recording in this way, recording was performed in the scanning direction shown in FIG. 13A. Direction 1 is the forward direction (in the order: K, C, M, Y), and direction 2 is the backward direction (Y, M, C, K).

As a result, by further restricting the conditions as compared with the embodiment 1-3, the number of times that reciprocating recording is effected increases, making it possible to perform recording at higher speed. However, in the case in which an image as shown in FIG. 13B is recorded, there is a difference in hue between portion A and portion B although it is not so conspicuous since the regions are not adjacent to each other. Thus, as compared with the case in which recording is performed by the method of the third embodiment, there is some deterioration in quality.

Similar results were obtained regarding R and B.

| | |
|---|---|
| Yellow ink | |
| *glycerine | 5.0% by weight |
| *thioglycol | 5.0% by weight |
| *urea | 5.0% by weight |
| *acetinol EH (manufactured by Kawaken Fine Chemical) | 1.0% by weight |
| *dye C.I. direct yellow 142 | 2.0% by weight |
| *water | 82.0% by weight |
| Magenta ink | |
| *glycerine | 5.0% by weight |
| *thioglycol | 5.0% by weight |
| *urea | 5.0% by weight |
| *acetinol EH (manufactured by Kawaken Fine Chemical) | 1.0% by weight |
| *dye C.I. acid red 289 | 2.5% by weight |
| *water | 81.5% by weight |
| Cyan ink | |
| *glycerine | 5.0% by weight |
| *thioglycol | 5.0% by weight |
| *urea | 5.0% by weight |
| *acetinol EH (manufactured by Kawaken Fine Chemical) | 1.0% by weight |
| *dye C.I. direct blue 199 | 2.5% by weight |
| *water | 81.5% by weight |
| Black ink | |
| *glycerine | 5.0% by weight |
| *thioglycol | 5.0% by weight |
| *urea | 5.0% by weight |
| *acetinol EH (manufactured by Kawaken Fine Chemical) | 0.1% by weight |
| *dye C.I. hood black 2 | 3.0% by weight |
| *water | 81.9% by weight |

Second Embodiment

To be described in the following will be an invention in which color inconsistency between scanning operations in recording is taken into consideration.

FIG. 18 shows a recording head in which nozzles 101*k*, 101*c*, 101*m* and 101*y* for ejecting black ink, cyan ink, magenta ink, and yellow ink are arranged in the scanning direction. In this example, a solidly printed image in a secondary color (blue) is recorded.

Figure 18A:
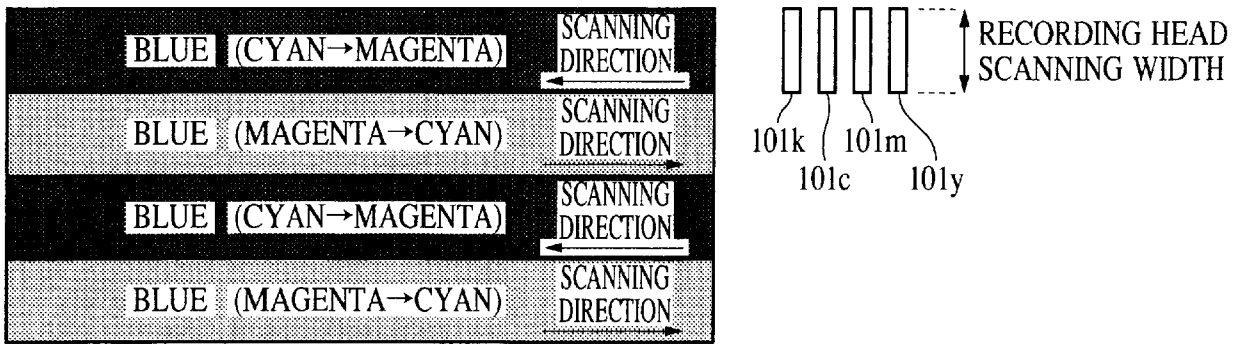
FIGS. 18A and 18B, is a diagram illustrating color inconsistency when reciprocative recording is performed.

FIG. 18A shows color inconsistency generated in a conventional recording method. In this example, a blue image in a region wider than the single scanning width of the recording head is recorded; the order in which cyan ink and magenta ink are superimposed on each other differs between the forward scanning and the backward scanning, so that color inconsistency is generated in a width corresponding to the scanning width of the recording head.

Figure 18B:
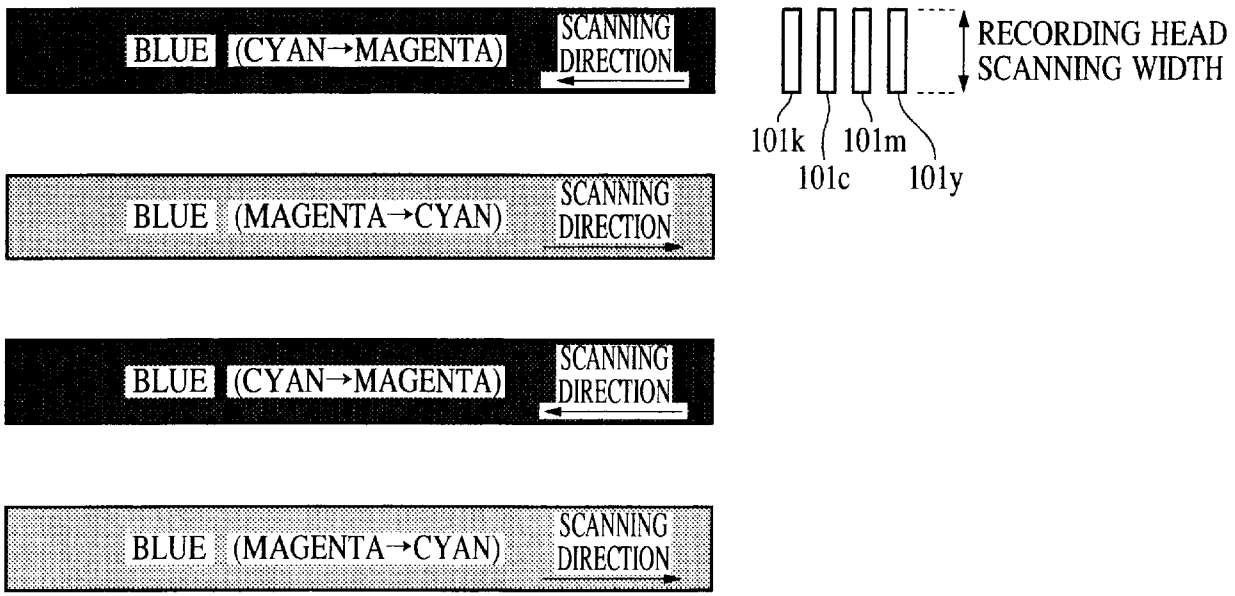

On the other hand, in FIG. 18B, solidly printed blue images are separated in the paper feeding direction, and each blue image has a width which allows recording through one scanning by the recording head. In this example also, as shown in the drawing, each blue image is recorded by both the forward scanning and the backward scanning of the recording head, so that color inconsistency is generated in a width corresponding to the scanning width of the recording head.

However, in the actual image, the color inconsistency is more conspicuous in FIG. 18A than in FIG. 18B. This is due to the fact that the detection ability of the human eye is higher in the case in which images of different hues are adjacent to each other than in the case in which they are not adjacent to each other.

Figure 19:
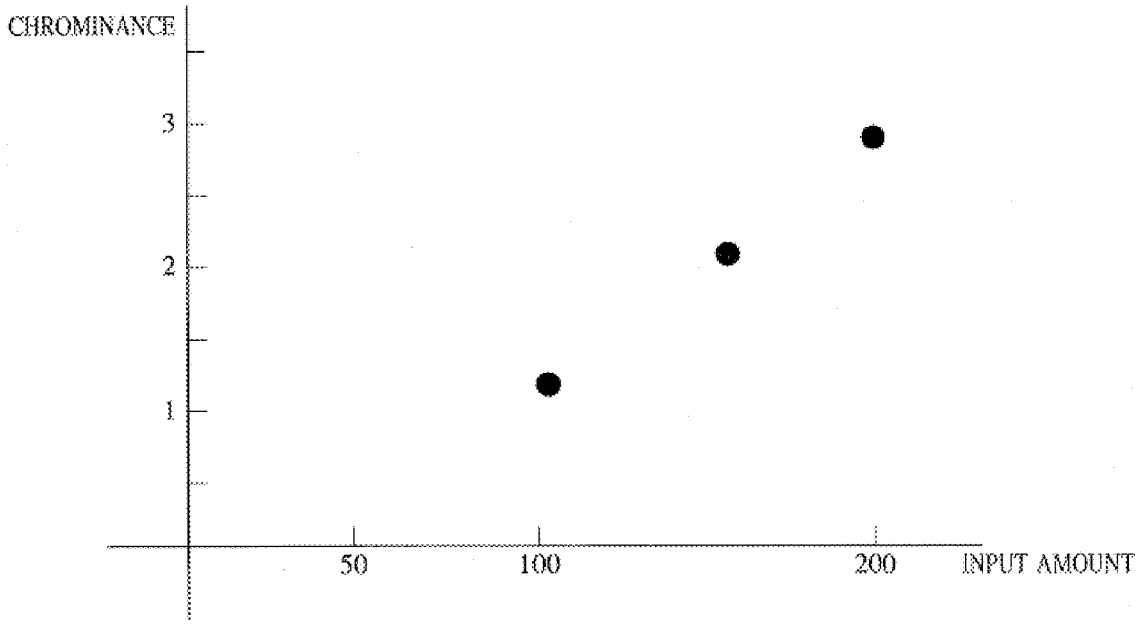
FIG. 19 is a diagram showing ink input amount and color inconsistency.

FIG. 19 shows a difference in color between the forward scanning and backward scanning in the case in which recording of successive images is conducted through forward scanning and backward scanning of the recording head. The duty (the amount of ink imparted) of the successive images is varied as a parameter. In this diagram, when the imparting amount is 200%, it means that an approximately 8.5 pl of ink droplet is imparted twice, both for cyan ink and magenta ink, to a paper surface of 1/600 in. square, that is, approximately 17 pl of ink is imparted to a paper surface of 1/600 in. square. The chrominance indicates the distance in the Lab space between the blue in the forward scanning and the blue in the backward scanning. As is apparent from this drawing, the chrominance is large in the region where the image duty is high, the color inconsistency of the image being conspicuous to the eye.

As described above, when performing recording through forward scanning and backward scanning of a recording head, conspicuous color inconsistency is not always generated. That is, if images smaller than the scanning width of the recording head are not adjacent to each other, the color inconsistency is not so conspicuous. Conversely, even if the image is larger than the scanning width of the recording head, the color inconsistency is not so conspicuous if the duty of the image is not high.

The present invention has been made in view of this characteristic. If it is determined that color inconsistency is not easily generated from a plurality of different regions in image data corresponding to the scanning region where recording is performed, recording is performed through both the forward scanning and the backward scanning. Conversely, when it is determined that color inconsistency is easily generated, recording is performed only through forward scanning or backward scanning. As the plurality of regions, image data corresponding to the portion which is relatively at the end of the scanning width of the recording head and image data corresponding to the entire scanning width of the recording head.

While in the embodiment described below a heat generating element is used as the recording element generating the energy for ejecting ink, this should not be construed restrictively as in the above embodiment. It is also possible to use a piezoelectric element. Further, the heat generating element is not restricted to a heat generating resistor. Any type of element will do as long as it is capable of generating heat and causing ink to be ejected.

The second embodiment of the present invention will now be described in detail with reference to the drawings.

Embodiment 2-1

Figure 20:
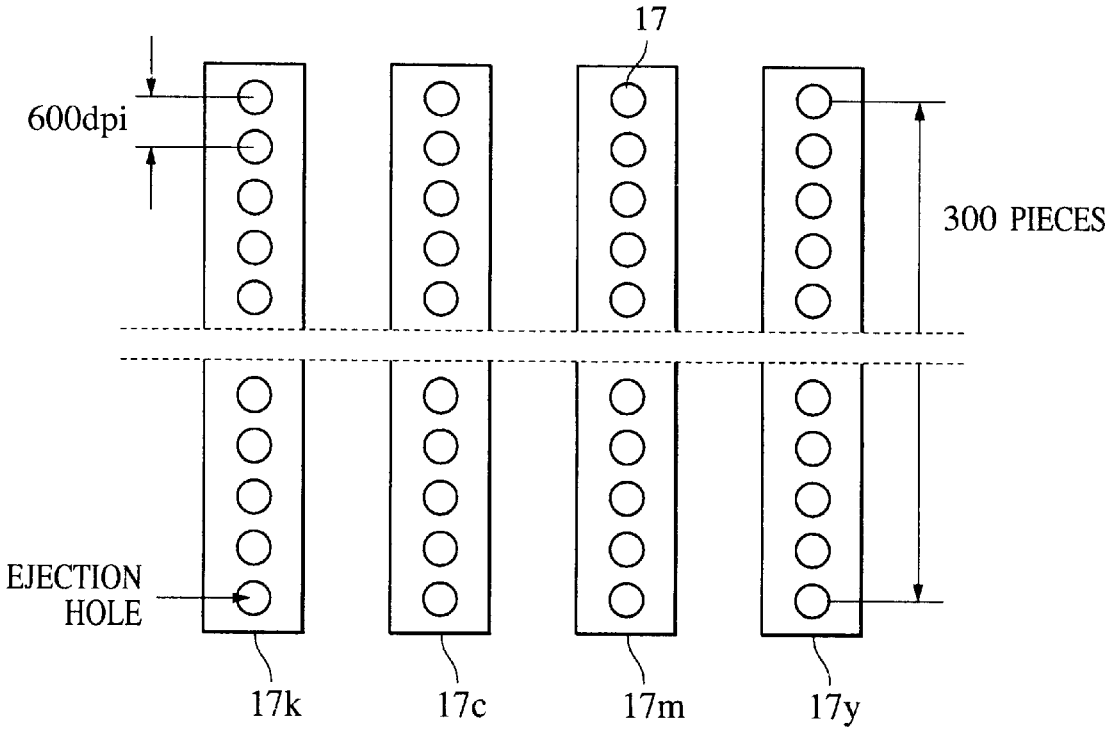
FIG. 20 is a diagram illustrating the construction of a recording head used in the embodiment.

FIG. 20 is a drawing showing the recording head used as the recording means in this embodiment as seen from the ejection hole side; it has a row of ejection holes in which 300 ejection holes are arranged at a density of 600 per inch. A recording head 17*k* for ejecting black ink, a recording head 17*c* for ejecting cyan ink, a recording head 17*m* for ejecting magenta ink, and a recording head 17*y* for ejecting yellow ink, which are spaced apart from each other, are arranged in the recording head scanning direction.

An ink path is provided in correspondence with each ejection hole, and a recording element generating energy for ejecting ink is provided in correspondence with each ejection hole.

The amount of ink ejected from the ejection hole is approximately 30 ng in the case of black ink, and approximately 15 ng in the case of the other inks. To realize high density, the ejection amount of black ink is relatively large.

Next, to be described will be a method for detecting whether color inconsistency is generated for each scanning or not when an image is recorded by alternately repeating the forward scanning and the backward scanning of the recording head.

Figure 21A:
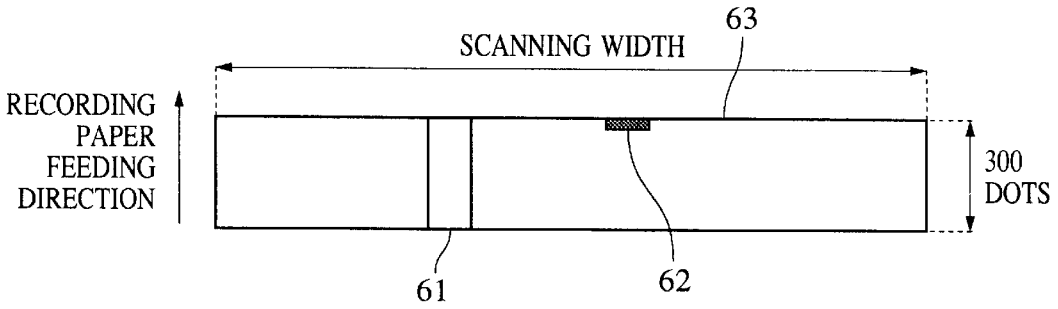
FIGS. 21A, 21B, and 21C, is a diagram illustrating a window for calculating recording duty in embodiment 2-1.

FIG. 21A shows a method for calculating the recording duty of a predetermined region of image data in an image region (scanning region, also referred to as "band") of the scanning width of the recording head×300 dots (recording width of the recording head). In this case, two windows are used as a plurality of windows. There is prepared a window B62 for calculating the duty in the vicinity of the boundary (boundary leading to a different band) of an image region, the recording duty in the window being calculated from the image data in this window while scanning the window in the image region.

A window A61 is of a size in which the lateral resolution per inch: 600 dots=600 dpi and is used to calculate the recording duty (duty over the entire width of the image region in the recording medium feeding direction) over the entire recording width of the recording head. In this embodiment, it is a window of a size of longitudinally 300 dots×laterally 128 dots.

A window B is used to calculate the recording duty of a region in the vicinity of a border of an image region (border connected to an adjacent band) for performing recording by each scanning. In this embodiment, it is a window of a size of longitudinally 32 dots×laterally 128 dots.

Regarding the position and size of the window, in the case of the window B62, it is set in the vicinity of the end of the band, that is, at the position near the inter-band border where the recording duty is read. It is desirable that it be in range in which the recording duty of the region from the border 63 to a position spaced apart therefrom by 0.5 mm to 5 mm. Further, it is desirable to set it at a position where the recording duty of the dot closest to the boundary 63. However, it is also possible to set the position so as to be spaced apart from the boundary 63 by several dots.

In the case of the window A61, it is desirable that it be a window of a width which allows reading of the entire width (band width) in the direction perpendicular to the head scanning direction. However, it is only necessary for the recording duty of the band width to be reflected, and it is possible to set the position so as to be spaced apart from the boundary 63 by several dots.

Further, while in this example the lengths of the windows A and B in the head scanning direction (band length direction) are 128 dots, this should not be construed restrictively. Any length will do as long as the recording duty of the window can be easily calculated.

In the above windows A and B, the image data number calculated in each window differs in this embodiment. In the window A, calculation is performed in a relatively large image data number to capture the average density distribution in the scanning region, and, in the window B, calculation is performed in a relatively small image data number to capture the local density distribution in the border portion.

However, this effect can also be obtained by designating the window to a position which reflects the border portion and the band width as described above, so that it is not absolutely necessary to adopt the image data number relationship of this embodiment.

The calculation of the recording duty in these windows is conducted by the recording control portion using image data stored in the buffer 309.

Figure 21B:
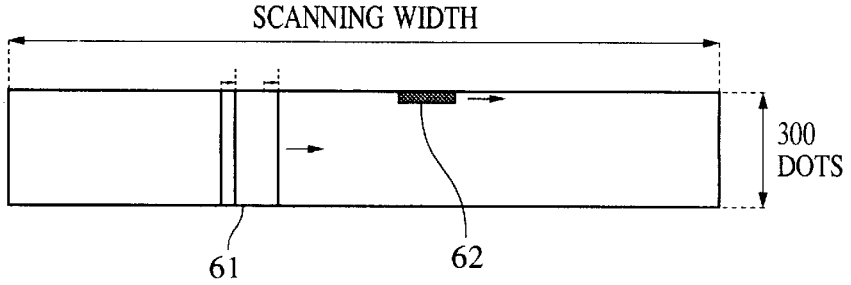
Figure 21C:
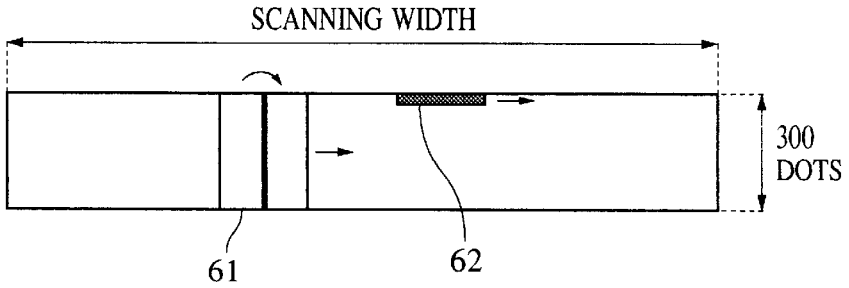

The window scanning method may, as shown in FIG. 21B, be a scanning method in which the recording duty is calculated by shifting each window in one line unit in the scanning direction of the recording head (band width direction), or, as shown in FIG. 21C, a scanning method in which the recording duty is calculated by shifting by the length of each window in the band length direction (laterally 128 dots in this embodiment).

The recording duty Dc of the cyan image in the window, the recording duty Dm of the magenta image, and the recording duty Dy of the yellow image are respectively counted and the sum total Dc+Dm+Dy is obtained as the in-window recording duty at a certain window position.

The recording duty threshold values of the windows are set to be 125% for the window A and 100% for the window B in this embodiment. Here, when the recording duty is 100%. the color ink dot number recorded at the pixel position of 1/600 inch×1/600 inch is one. Thus, in an image of cyan 100%, for example, the region is filled with cyan dots, and 200% implies a blue solid image, which is filled with cyan and magenta dots.

That is, the recording duty is the ratio of the color materials imparted to the unit recording region. In the case of a primary color, it is 100% at maximum, and, in the case of a secondary color, it 200% at maximum.

When the recording data duty of the window A at all positions in the recording region where recording is to be performed is 125% or less, and the recording duty of the window B at all positions is 100% or less, recording is performed through both the forward scanning and the backward scanning (reciprocating scanning) to thereby increase the recording speed, and, when either of the conditions is not satisfied, recording is performed through either the forward scanning or the backward scanning (one direction recording) to thereby reduce the recording inconsistency.

Further, in this embodiment, the recording duty threshold value of the window A is smaller than the recording duty threshold value of the window B due to the fact that the window B is the recording duty of a border portion, so that even a little inconsistency is liable to be conspicuous. Conversely, when the threshold value of the window A is reduced, the ratio of the one-direction recording becomes too large, resulting in a reduction in the recording speed.

Figure 3A:
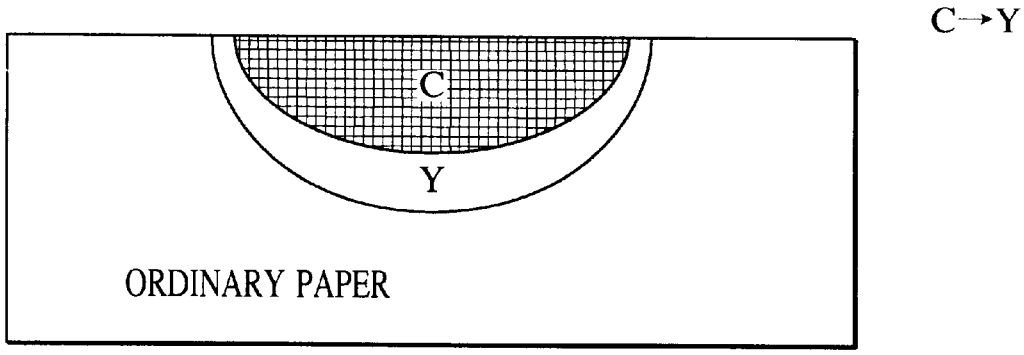
FIGS. 3A and 3B, is an explanatory diagram illustrating how color inconsistency is generated.
Figure 3B:
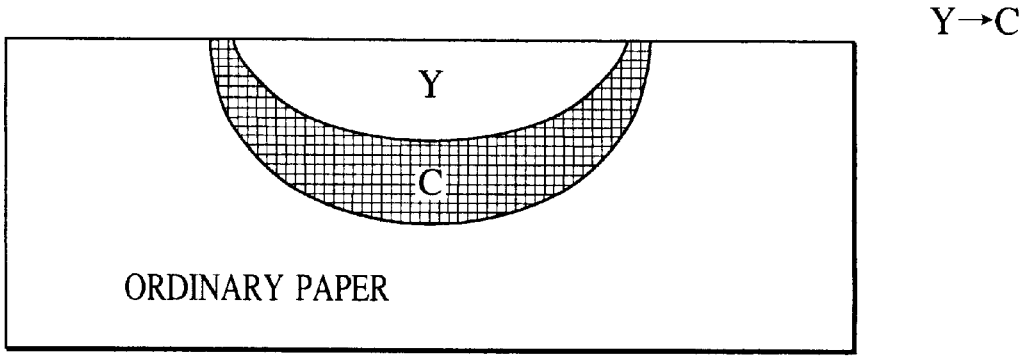
Figure 4:
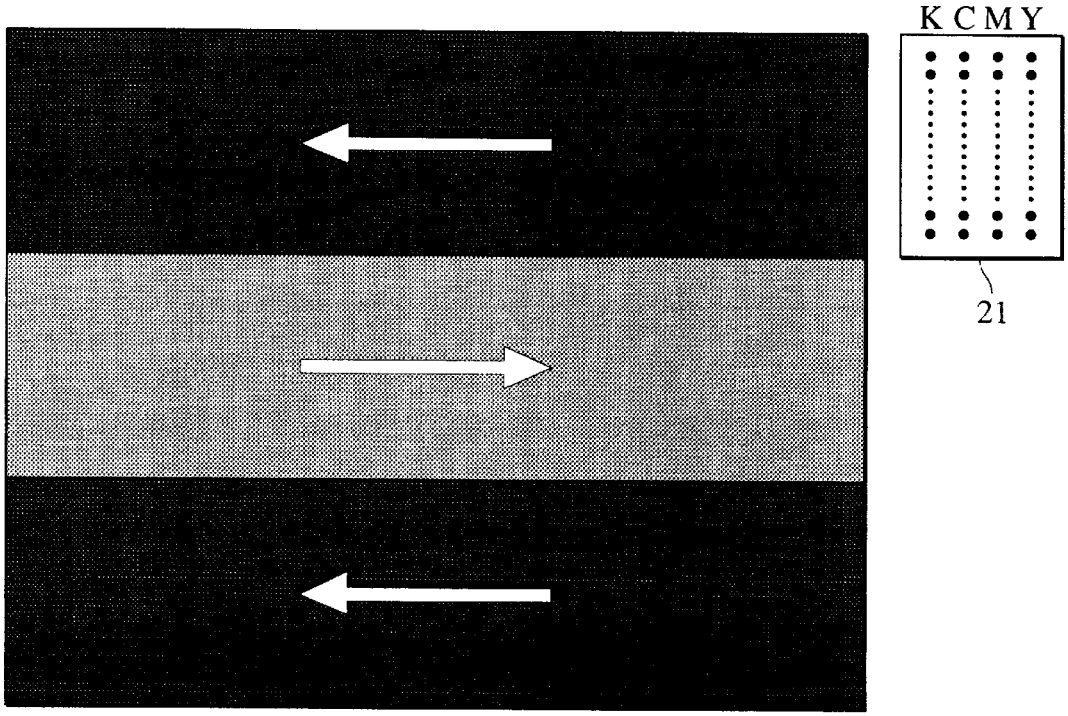
FIG. 4 is a diagram illustrating how color inconsistency is generated.
Figure 22:
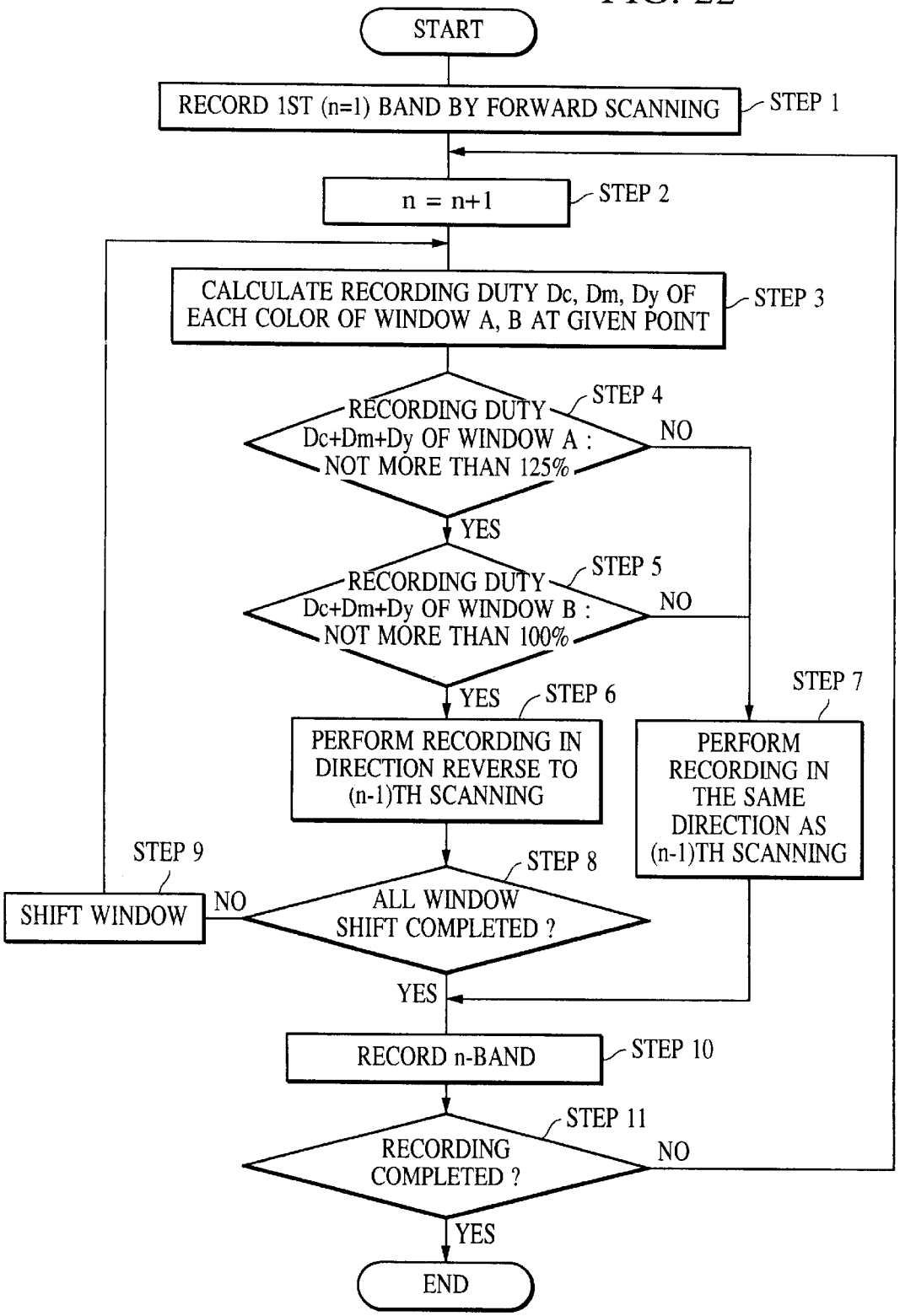
FIG. 22 is a diagram illustrating the operational flow in embodiment 2-1.

FIG. 22 is a flowchart of the above operation. First, in step 1, the first scanning (n=1) recording is conducted by the recording head in accordance with the image data. While in this embodiment the scanning is started from the home position side (the recovery means side of FIG. 3) of the recording head, this should not be construed restrictively.

Subsequently, in step 2, n is made equal to n+1 for transition to the next scanning (second band recording).

In step 3, the recording duty of the window A and the window B at a certain position in the next scanning (for example, the second scanning) is calculated from the recording duty of each color, and, in step 4, a judgment is made as to whether the recording duty of the window A is not more than 125% or not. If it is not more than 125%, the procedure advances to step 5, and when it exceeds 125%, the procedure advances to step 7. When it is not more than 125%, the procedure advances to step 5, where a judgment is made as to whether the recording duty of the window B is not more than 100% or not. When it is not more than 100%, the procedure advances to step 6, and when it exceeds 100%, the procedure advances to step 7. In step 6, setting is made such that recording is performed in a direction reverse to that of the previous recording (here, it is the first scanning), that is, reciprocating recording is performed. In step 7, setting is made such that recording is performed in the same direction as in the previous recording, that is, one-direction recording is performed.

After step 6, a judgment is made in step 8 as to whether each window has completed all the shift within n-band. When it has not completed yet, the window is shifted to the next position in step 9. After the shift, the procedure returns to step 3, where reading calculation is performed until the completion of all the shift to see whether there is a portion where the recording duty exceeds a reference value.

If all the shift of the window has been completed, when there is no window in which the reference value is exceeded, recording is performed in a direction reverse to the (n−1)th band (step 10).

When in step 7 the recording in the same direction as in the previous band is set, recording is performed in this embodiment without calculating the recording duty of the next window.

The above operations are repeated until all the recording is completed.

Figure 23:
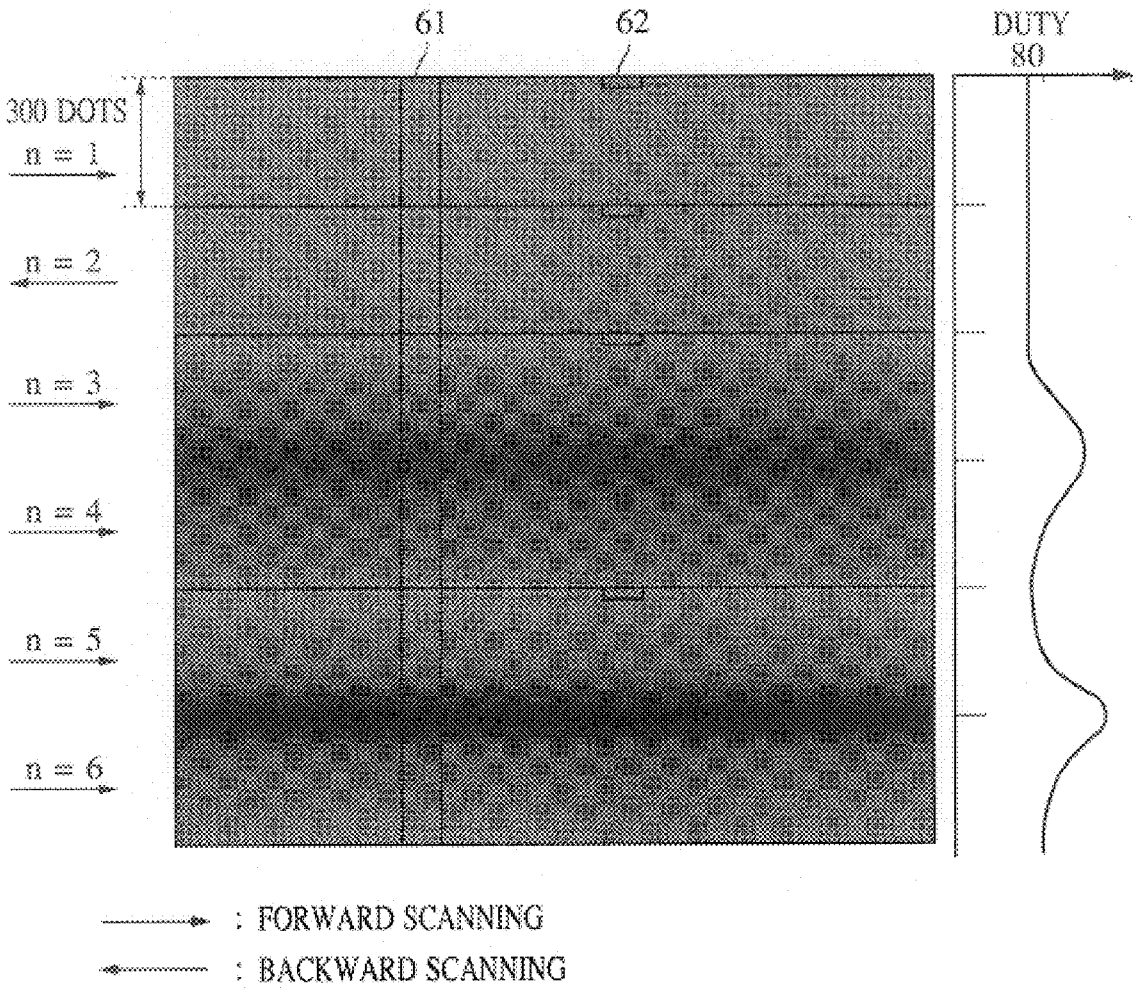
FIG. 23 is a diagram illustrating recording operation in embodiment 2-1.

FIG. 23 shows an example to which this embodiment is applied. Here, 6-band data is shown from n=1, the recording duty of each band being shown through shading and the duty graph on the right-hand side.

First, in the first scanning (n=1), recording is performed through forward scanning. In the subsequent second scanning, the recording duty of the window A61 and the recording duty of the window B62 are calculated. Here, suppose both maximum recording duties are 80%.

As a result, the recording direction of the second scanning is reverse to that of the first scanning, and recording is performed through backward scanning. However, since the recording duty in the border portion between the first scanning and the second scanning is low, the color inconsistency is not conspicuous.

Next, suppose in the third scanning the recording duty of the window A is calculated as 115% and the recording duty of the window B 80%. As a result, the recording direction of the third scanning is reverse to that of the second scanning, recording being performed through forward scanning. However, in the border portion between the second scanning and the third scanning also, the recording duty is low, so the color inconsistency is not conspicuous.

Further, suppose in the fourth scanning the recording duty of the window A is calculated as 115% and the recording duty of the window B 150%. As a result, the recording direction of the fourth scanning is the same as the third scanning, the recording being performed through forward scanning, so that there is no color inconsistency in the border portion between the third scanning and the fourth scanning.

Suppose in the subsequent fifth scanning the recording duty of the window A is calculated as 150% and the recording duty of the window B 80%. As a result, the recording direction of the fifth scanning is the same as the fourth scanning, the recording being performed through forward scanning, so that there is no color inconsistency in the border portion between the fourth scanning and the fifth scanning.

Suppose in the last, sixth scanning the recording duty of the window A is calculated as 150% and the recording duty of the window B 1750%. As a result, the recording direction of the sixth scanning is the same as the fifth scanning, the recording being performed through forward scanning, so that there is no color inconsistency in the border portion between the fifth scanning and the sixth scanning.

As described above, in accordance with this embodiment, the recording duty of a predetermined region in the scanning of the recording to be conducted is calculated, and when the recording duty is low, reciprocating recording is performed, and, when the recording duty is high, one-direction recording is performed, so that it is possible to record an image in which color inconsistency is not conspicuous in a short time, that is, at high speed.

Further, while in this embodiment when the calculation value exceeds before the completion of the entire shift of the window, recording is performed after determining recording direction without performing the calculation after that, it is also possible to effect transition to recording after the completion of the entire shift.

Embodiment 2-2

When reciprocating recording of images in secondary colors, red, green and blue, is conducted, the degree to which color inconsistency is generated differs between forward scanning and backward scanning. This is to be assumed to be attributable to the ink characteristics and difference in time in color superimposition due to the physical distance between the heads of different colors. Taking this into consideration, when calculating the recording duty in a predetermined region, the recording duty of a specific color is calculated in addition to simply summing the recording duties for the different colors, whereby it is possible to record an image of higher quality at high speed.

In this embodiment, a control example is shown in which a secondary color image is thus taken into consideration.

Figure 24:
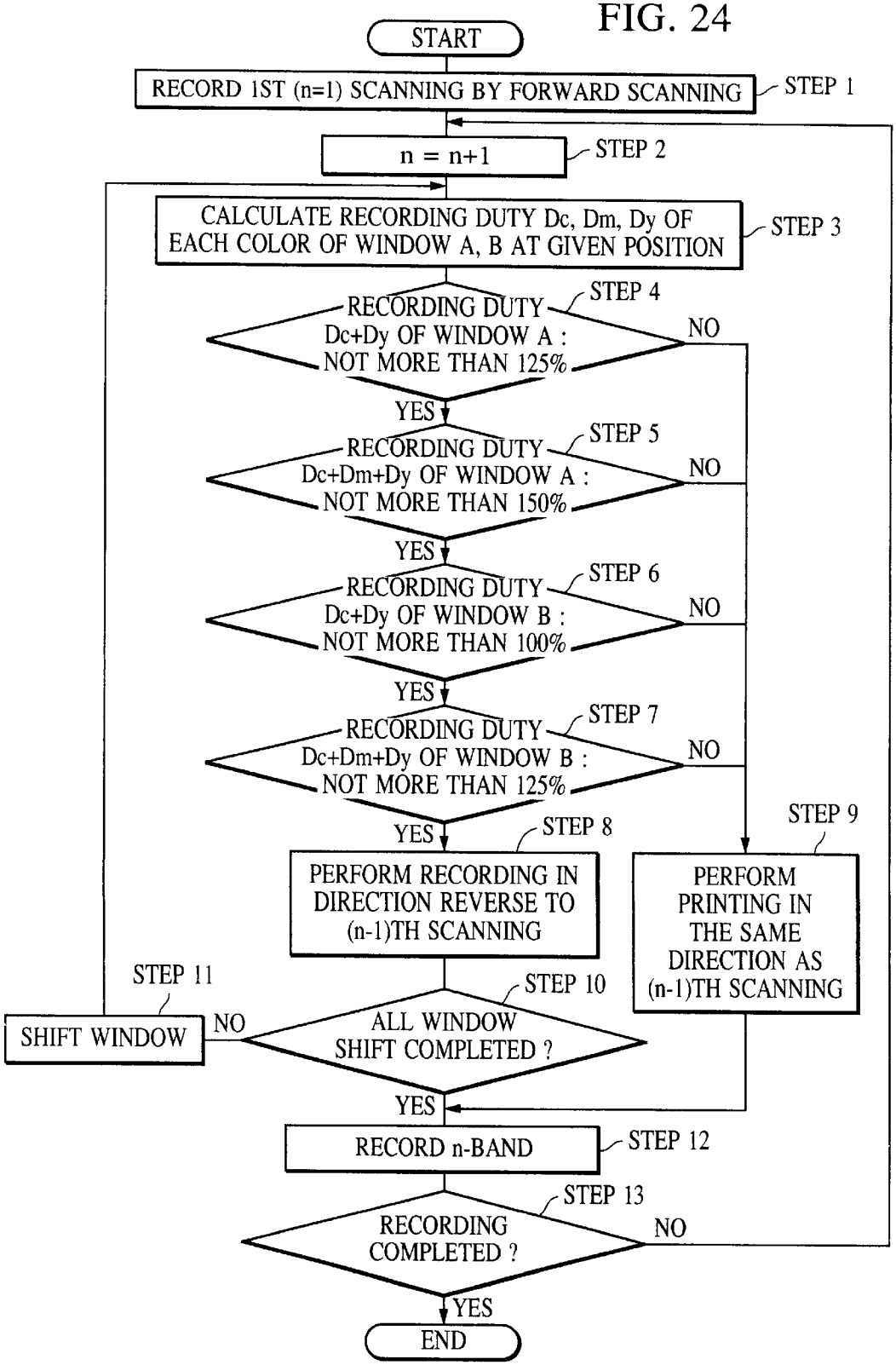
FIG. 24 is a diagram illustrating the operational flow in embodiment 2-2.

For example, with reference to FIG. 24, to be described will be the operational flow in the case in which green is taken into account, in which color the color inconsistency is relatively conspicuous as compared to red and blue when a secondary color image of the same duty is recorded through reciprocating recording.

The operation up to the third step is the same as that of the embodiment 2-1, so a description thereof will be omitted.

In step 4, the recording duty Dc+Dy of green in the window A at a position where n-band exists is first calculated. When it is not more than 125%, the procedure advances to step 5, and when it exceeds 125%, the procedure advances to step 9. In step 5, the total recording duty Dc+Dm+Dy in the window A at the same position is calculated. When it is not more than 150%, the procedure advances to step 6, and when it exceeds 150%, the procedure advances to step 9.

In steps 6 and 7, the green recording duty and the total recording duty in the window B at a certain position are calculated. Only when the green recording duty is not more than 100% and the total recording duty is not more than 125%, the procedure advances to step 8. In step 8, setting made such that recording is performed in the direction reverse to the (n−1) scanning, and in step 9, setting is made such that recording is performed in the same direction as the (n−1) scanning.

After step 8, a judgment is made in stop 10 as to whether the window has completed the shifting of all the positions in the n band. When it has not been completed, the window is shifted by one in step 11, and when it has been completed, the n band recording is performed.

As is apparent from the above description, regarding the green image, in which color inconsistency is conspicuous, the recording duty is checked as in the first embodiment to perform recording operation. However, regarding the blue and red images or the three-color mixed image, the threshold value is set to be high, so that if the duty is higher than in embodiment 2-1, recording is performed in both the forward scanning and the backward scanning, so that high speed recording is possible.

Embodiment 2-3

Figure 25:
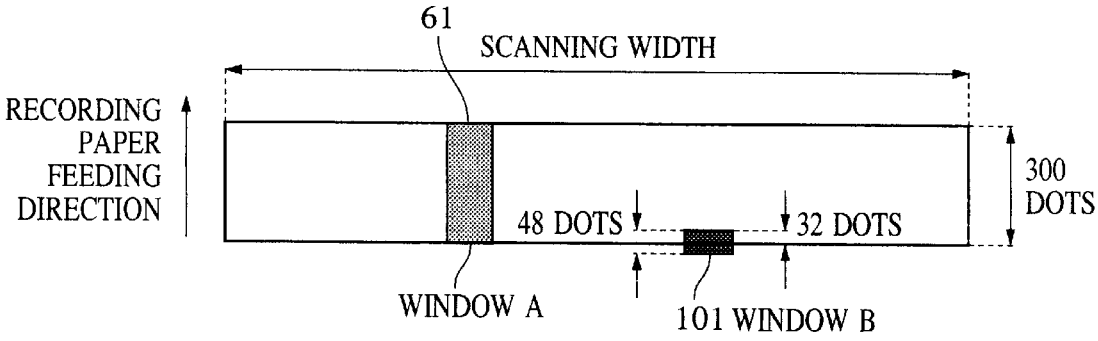
FIG. 25 is a diagram illustrating a window for calculating recording duty in embodiment 2-3.

FIG. 25 shows the window of this embodiment. It is different from that of the embodiment 2-1 in that the window B 101 calculates the recording duty of the region in the vicinity of the end portion on the upstream side with respect to the recording medium feeding direction. As is apparent from the drawing, the size of the window B in the longitudinal direction is 48 dots including the 32 dots of the end portion scanning to be recorded and the 16 dots of the subsequent scanning. In the lateral direction, it is 128, which is the same as that in embodiment 2-1.

This embodiment differs from the embodiment 2-1 in that, as described above, the window B is provided in the region in the vicinity of the end portion on the upstream side with respect to the recording medium feeding direction and that the duty in this window B is calculated and, taking this recording duty into consideration, the scanning direction of the band next to the band related to the duty calculation is determined.

Figure 26:
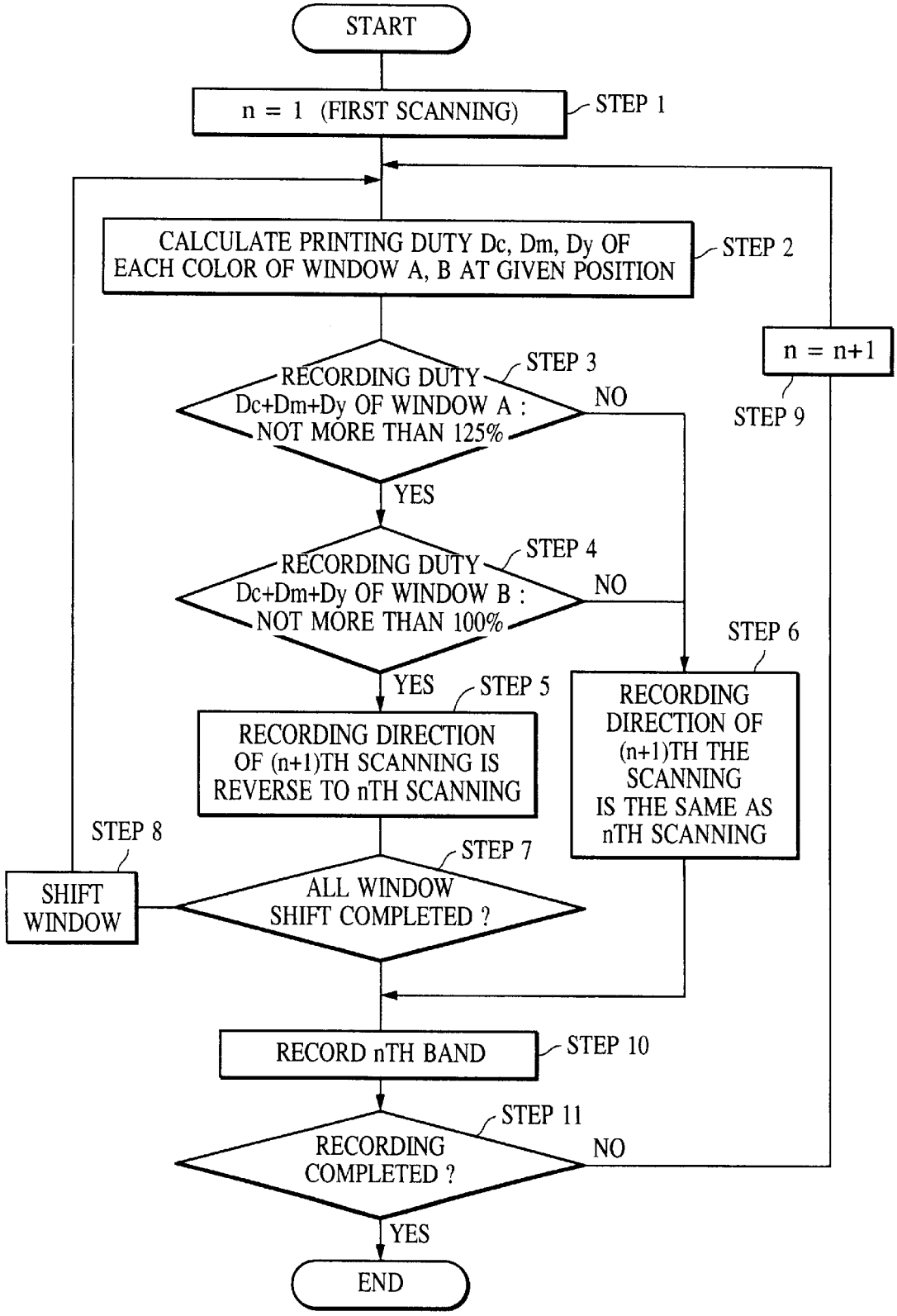
FIG. 26 is a diagram illustrating the operational flow in embodiment 2-3.

FIG. 26 is a flowchart of this embodiment. In step 1, setting is made such that n=1, and, in step 2, the recording duties of the window A and the window B at a certain position in the n-th scanning (for example, the first scanning) from the recording duty of each color. In step 3, a judgment is made as to whether the recording duty of the window A is not more than 125% or not. When it is not more than 125%, the procedure advances to step 4. When it exceeds 125%, the procedure advances to step 6. When the procedure advances to step 4, a judgment is made as to whether the recording duty of the window B is not more than 100% or not. When it is not more than 100%, the procedure advances to step 5, and when it exceeds 100%, the procedure advances to step 6.

In step 5, it is determined that the recording direction of the (n+1)th scanning (for example, the second scanning) is reverse to that of the n-th scanning (here, it is the first scanning). Next, as in the previous embodiment, a judgment is made in step 7 as to whether the entire shift of the window has been completed or not. When it has not been completed yet, the procedure advances to step 8, where the window is shifted and the procedure returns to step 2. On the other hand, in step 6, it is determined that the recording direction of the (n+1)th scanning (for example, the second scanning) is the same as that of the n-th scanning (here, it is the first scanning).

After this, in step 7, the n-th band recording is executed (step 10). In step 11, a judgment is made as to whether all the recording has been completed or not. When it has not been completed yet, n=n+1 in step 9, and he next scanning processing is performed. The above operation is repeated until the recording is completed.

Figure 27:
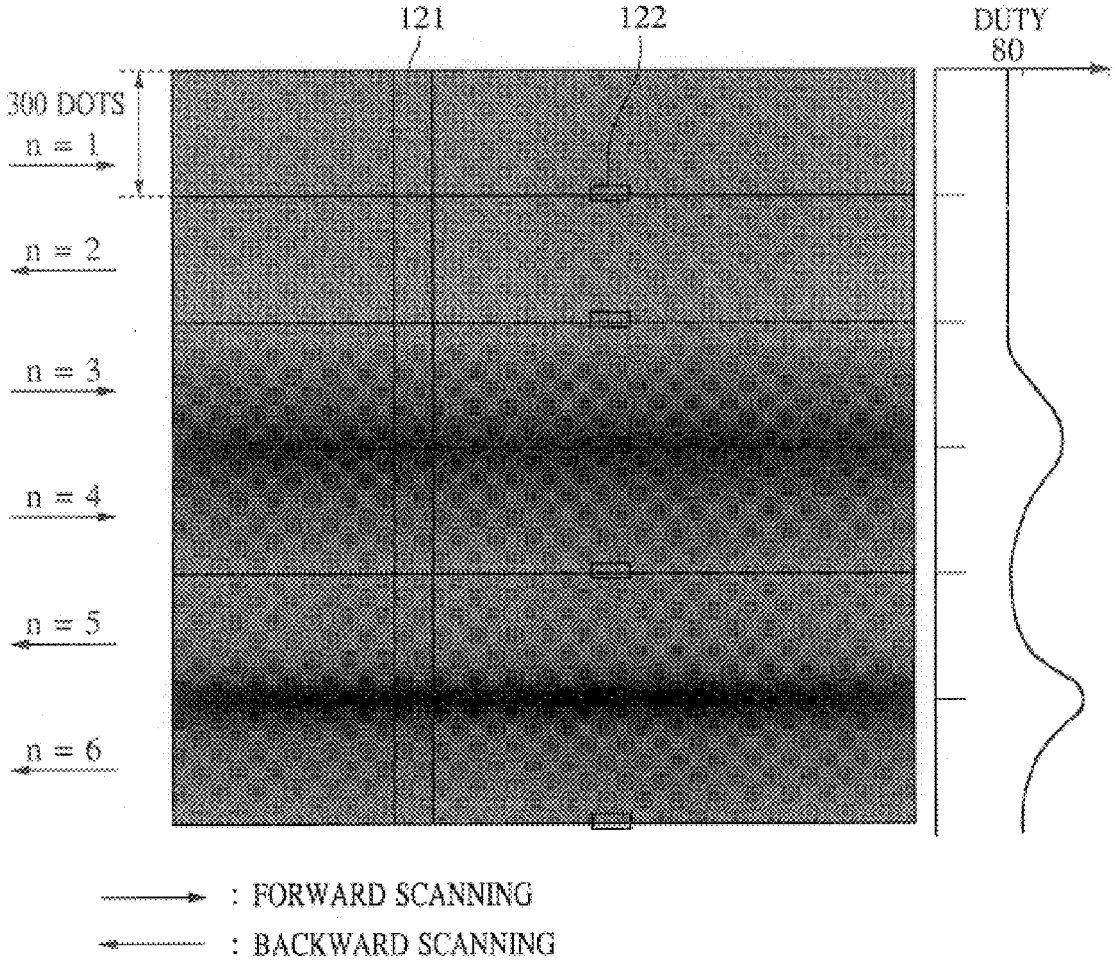
FIG. 27 is a diagram illustrating recording operation in embodiment 2-3.

FIG. 27 shows an example to which this embodiment is applied. The expression in FIG. 27 is in conformity with FIG. 23.

First, in the first scanning (n=1), the recording duty of the window A121 and the recording duty of the window B121 are calculated. Here, it is assumed that the recording duty of the entire window is 80% for both of them. As a result, after it is determined that the recording direction of the second scanning is reverse to that of the first scanning, the first scanning is first performed in forward direction to perform recording. Here, in the first scanning, recording may be started with forward scanning or backward scanning. Assuming that the first scanning is started with forward scanning, recording by the second scanning is performed through backward scanning.

In the subsequent second scanning also, the recording duty of the window A and the recording duty of the window B are calculated. Here, suppose the recording duty of the entire window is 80% for both of them. As a result, after it is determined that the recording direction of the third scanning is reverse to that of the second scanning and recording is performed through forward scanning, the recording of the second scanning is performed. The recording duty in the border portion between the first scanning and the second scanning is low, so that the color inconsistency is not conspicuous.

Next, suppose that, in the third scanning, the recording duty of the window A is counted as 115% and the recording duty of the window B 150%. As a result, the recording direction of the fourth scanning is the same as that of the third scanning, and it is determined that the recording is performed through forward scanning. After this, the recording of the third scanning is performed. However, the recording duty is also low in the border between the second scanning and the third scanning, so that the color inconsistency is not conspicuous.

Further, suppose that, in the fourth scanning, the recording duty of the window A is counted as 115% and the recording duty of the window B 80%. As a result, the recording direction of the fifth scanning is reverse to that of the fourth scanning, and it is determined that the recording is performed through backward scanning. After this, the recording of the fourth scanning is performed. However, no color inconsistency is generated in the border portion between the third scanning and the fourth scanning, the recording directions being the same.

Subsequently, suppose that, in the fifth scanning, the recording duty of the window A is counted as 150% and the recording duty of the window B 175%. As a result, the recording direction of the sixth scanning is the same as that of the fifth scanning, and it is determined that the recording is performed through backward scanning. After this, the recording of the fifth scanning is performed. However, the recording duty is low in the border portion between the fourth scanning and the fifth scanning, so that no color inconsistency is generated.

Finally, suppose that, in the sixth scanning, the recording duty of the window A is counted as 150% and the recording duty of the window B 80%. As a result, the recording direction of the sixth scanning is the same as that of the fifth scanning, and it is determined that the recording is performed through backward scanning. After this, the recording of the sixth scanning is performed. However, no color inconsistency is generated in the border portion between the fifth scanning and the sixth scanning, the recording directions being the same.

As described above, in this embodiment, the direction of the next scanning is determined on the basis of the scanning data to be recorded. The example shown in FIG. 27 is the same image as that of the embodiment 2-1 shown in FIG. 27. However, the fifth and sixth scanning directions differ from those of the embodiment 2-1. However, in either example, it is possible to restrain the color inconsistency between the scanning operations, so that either method may be adopted.

Other Embodiment 1

While in the embodiments 2-1 and 2-2 image data exists in the window B, with the result that the feeding amount of the recording medium is 300 nozzles, which corresponds to the recording width of the recording head, when the recording duty of the window B is 0%, that is, when there exists no image data, it is possible to feed the recording medium by a surplus amount corresponding to that.

Figure 28A:
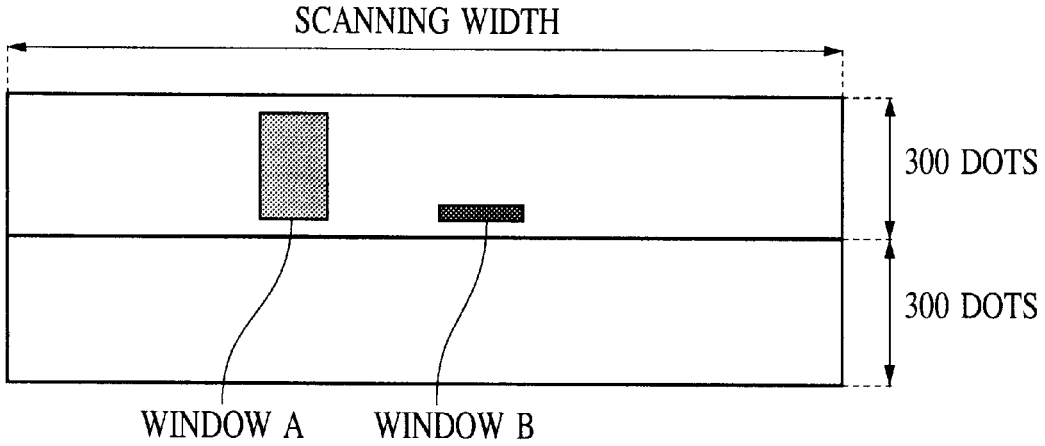
FIGS. 28A and 28B, is a diagram illustrating another example of a window for calculating recording duty.
Figure 28B:
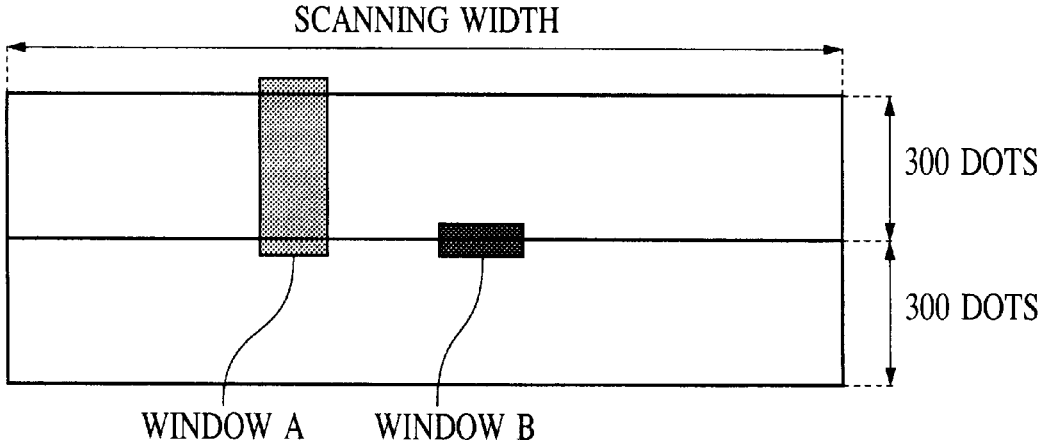

Further, the size of the window is not restricted to that of the first embodiment. For example, as shown in FIG. 28A, it may also be a region smaller than that of the embodiment 2-1. Further, as shown in FIG. 28B, it may extend beyond the width to be scanned and over the previous and the next scanning. In the case of FIG. 28B, it is possible to detect the generation of color inconsistency in the scanning border portion more accurately.

Other Embodiment 2

While in the above embodiments the calculation of the recording duty using the window is performed by the recording control portion 310 on the basis of the data retained by the buffer 309 (FIG. 6) in the recording apparatus, this should not be construed restrictively. It is also possible to perform the calculation on the host computer 306 side as the apparatus for controlling the recording apparatus, that is, by the print driver.

In this case, as in the above embodiments, in which the recording data of the band to be recorded by each scanning on the host computer 309 side, the recording duty is calculated by using the window to determined the scanning direction of each band. And, by the transmission means of the host computer, it is transferred with the recording data or individually from the host side to the recording apparatus side, thereby performing recording.

While the control command such as a program for performing the processing of the above embodiments may be retained in the recording apparatus as in the above embodiment, it may also be retained in the host computer as in this embodiment. Further, apart from this, it may be retained by various storage mediums; before or during the processing, the control command is read from this storage medium, and the above processing is performed.

The storage medium may be of any type, magnetic or optical, such as a floppy disk, CD-ROM, MO, MD or DVD as long as it can store the control command and allows reading to the exterior. Further, it is not restricted to a storage medium which can be easily removed from the reading apparatus and carried; it may also be a packaged ROM or the like, which is mounted to the apparatus.

Figure 29:
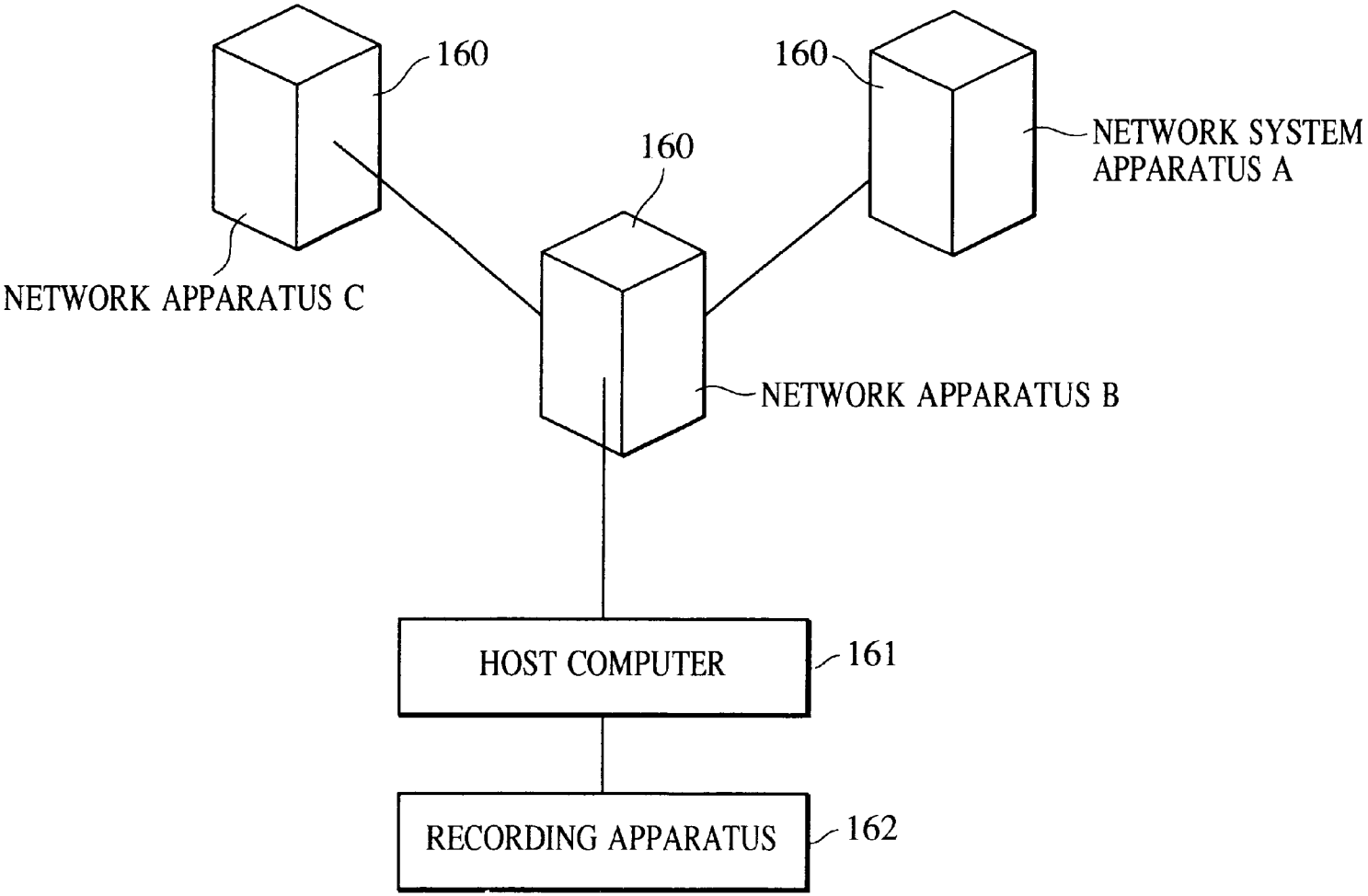
FIG. 29 is a diagram illustrating network construction.

Further, it is also possible to retain the above control command in the network apparatus 160 shown in FIG. 29, this control command being transferred through a network to the host computer connected to the network apparatus using the transmission means of the network apparatus.

By adopting the ink-jet recording method and the ink-jet recording apparatus of the present invention, it is possible to record a color image at high speed while restraining the deterioration of the image quality due to color inconsistency.

As described above, in accordance with the present invention, in a recording apparatus in which recording heads ejecting inks of different colors are arranged in the scanning direction, to calculate the recording duty from the image data of a predetermined region to determine the recording direction, reciprocating direction is performed when it is determined that color inconsistency is not easily generated, making it possible to perform high speed recording. Further, when it is determined that color inconsistency is easily generated, one direction recording is performed, making it possible to minimize the reduction in recording speed.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink-jet recording method in which scanning is performed with a recording means having a plurality of recording element groups in correspondence with inks of different hues relatively in a direction crossing the direction in which the recording medium is fed to perform recording, the method comprising the steps of determining whether the scanning direction for recording is to be the same scanning direction as the adjacent scanning direction or is to be a different scanning direction from the adjacent scanning, according to the duty of the image data in the scanning for recording, and performing recording by performing scanning in the determined scanning direction.

2. An ink-jet recording method according to claim 1, wherein the scanning direction is determined in accordance with the recording duty of image data corresponding to each of the inks of different hues.

3. An ink-jet recording method according to claim 2, wherein the recording duty is a recording duty in a predetermined region of image data in the scanning for the recording to be performed.

4. An ink-jet recording method according to claim 2, wherein the recording duty is the number of dots recorded.

5. An ink-jet recording method according to claim 2, wherein the scanning direction is determined according to the recording duty of image data corresponding to at least one of a plurality of inks of different hues.

6. An ink-jet recording apparatus in which scanning is performed with a recording means having a plurality of recording element groups in correspondence with inks of different hues relatively in a direction crossing the direction in which the recording medium is fed to perform recording, comprising a means for determining whether the scanning direction for recording is to be the same scanning direction as the adjacent scanning direction or is to be a different scanning direction from the adjacent scanning, according to the duty of the image data in the scanning for recording, and a means for performing recording by performing scanning in the determined scanning direction.

7. An ink-jet recording apparatus according to claim 6, wherein the means for determining the scanning direction is a means for determining the scanning direction according to the recording duty of image data corresponding to each of the inks of different hues.

8. An ink-jet recording apparatus according to claim 7, wherein the means for determining the scanning direction is a means for determining the scanning direction on the basis of the recording duty in a predetermined region of image data in the scanning through which recording is to be performed.

9. An ink-jet recording apparatus according to claim 7, wherein the means for determining the scanning direction is a means for determining the scanning direction according to the recording duty based on the number of dots recorded.

10. An ink-jet recording apparatus according to claim 7, wherein the means for determining the scanning direction is a means for determining the scanning direction according to the recording duty of image data corresponding to at least one of a plurality of inks of different hues.

11. An ink-jet recording method comprising the following steps:

performing scanning using a recording means provided with a plurality of recording elements in correspondence with inks of different hues, and performing scanning in a direction in which scanning is performed relatively with respect to the recording medium, to effect recording on the recording medium determining whether the scanning direction for recording is to be the same scanning direction as the adjacent scanning direction or is to be a different scanning direction from the adjacent scanning, according to the recording duty obtained from a predetermined region of image data corresponding to the scanning region, and feeding the recording medium in a direction crossing the scanning direction, and in which recording is performed according to the scanning direction determined by said determining step, wherein the determination of the scanning direction is effected according to the duties of at least two regions, i.e., a first region positioned in a border portion of the scanning region as the predetermined region, and a second region that is different from the first region.

12. An ink-jet recording method according to claim 11, wherein the scanning in which the scanning direction is determined is the scanning of the scanning region in which the recording duty is calculated.

13. An ink-jet recording method according to claim 12, wherein the calculation is performed in a first region including substantially the entire region of the with in the direction crossing the direction in which the scanning region is scanned, and a second region in the vicinity of the end portion on the downstream side with respect to the direction in which is fed the recording medium of the scanning width of the scanning region.

14. An ink-jet recording method according to claim 11, wherein the scanning in which the scanning direction is determined is the scanning through which recording is performed subsequent to the scanning of the scanning region in which the recording duty is calculated.

15. An ink-jet recording method according to claim 14, wherein the calculation is performed in a first region including substantially the entire region of the with in the direction crossing the direction in which the scanning region is scanned, and a second region in the vicinity of the end portion on the upstream side with respect to the direction in which is fed the recording medium of the scanning width of the scanning region.

16. An ink-jet recording method according to claim 11, wherein the numbers of items of image data included in the plurality of different regions are different.

17. An ink-jet recording apparatus in which a recording means provided with a plurality of recording element groups in correspondence with inks of different hues in a direction in which scanning is performed relatively with respect to the recording medium is scanned to perform recording on the recording medium, and in which recording is performed according to the scanning direction determined by said determining means, the apparatus comprising a means for feeding the recording medium by a predetermined amount in a direction crossing the scanning direction a means for determining whether the scanning direction for recording is to be the same scanning direction as the adjacent scanning direction or is to be a different scanning direction from the adjacent scanning, according to the recording duty obtained from a predetermined region of image data corresponding to the scanning region, and a calculating means for determining the scanning direction according to the duties of at least two regions, i.e., a region positioned in the vicinity of a border portion of the scanning region as the predetermined region, and a region different from this.

18. An ink-jet recording apparatus according to claim 17, wherein the scanning in which the scanning direction is determined is the scanning of the scanning region in which the recording duty is calculated.

19. An ink-jet recording apparatus according to claim 18, wherein the calculation means performs the calculation in a first region including substantially the entire region of the with in the direction crossing the direction in which the scanning region is scanned, and a second region in the vicinity of the end portion on the downstream side with respect to the direction in which is fed the recording medium of the scanning width of the scanning region.

20. An ink-jet recording apparatus according to claim 18, wherein the calculation means is a means for calculating the sum total of the recording duties of the different colors.

21. An ink-jet recording apparatus according to claim 18, wherein the calculation means is a means for calculating the sum total of the recording duties of a specific color.

22. An ink-jet recording apparatus according to claim 17, wherein the scanning in which the scanning direction is determined is the scanning in which recording is performed subsequent to the scanning of the scanning region in which the recording duty is calculated.

23. An ink-jet recording apparatus according to claim 22, wherein the calculation means performs the calculation in a first region including substantially the entire region of the with in the direction crossing the direction in which the scanning region is scanned, and a second region in the vicinity of the end portion on the upstream side with respect to the direction in which is fed the recording medium of the scanning width of the scanning region.

24. An ink-jet recording apparatus according to claim 17, wherein in the plurality of different regions, image data included in these regions differs.

25. A control device in which a recording means provided with a plurality of recording element groups in correspondence with inks of different hues in a direction in which scanning is performed relatively with respect to the recording medium is scanned to perform recording on the recording medium, and in which recording is performed according to the scanning direction determined by said determining means, the device comprising a calculating means for determining the scanning direction according to the duties of at least two regions, i.e., a first region positioned in a border portion of the scanning region as a predetermined region, a determining means for determining whether the scanning direction for recording is to be the same scanning direction as the adjacent scanning direction or is to be a different scanning direction from the adjacent scanning, according to the recording duty obtained from the predetermined region of image data corresponding to the scanning region, and a transmission means for transmitting information regarding the determined scanning direction to the recording apparatus side.

26. A storage medium storing a control command in which a recording means provided with a plurality of recording elements in correspondence with inks of different hues in a direction in which scanning is performed relatively with respect to the recording medium is scanned to perform recording on the recording medium, and in which recording is performed according to the scanning direction, said scanning direction being determined by, the storage medium comprising a control command for calculating according to the duties of at least two regions, i.e., a first region positioned in a border portion of the scanning region as a predetermined region a control command for determining whether the scanning direction for recording is to be the same scanning direction as the adjacent scanning direction or is to be a different scanning direction from the adjacent scanning, according to the recording duty obtained from the predetermined region of image data corresponding to the scanning region, and a control command for determining the scanning direction according to the recording duties of these plurality of regions.

27. A network apparatus storing a control command in which a recording means provided with a plurality of recording elements in correspondence with inks of different hues in a direction in which scanning is performed relatively with respect to the recording medium is scanned to perform recording on the recording medium, and in which recording is performed according to the scanning direction determined according to the recording duty obtained from a predetermined region of image data corresponding to the scanning region, the network apparatus comprising a control command for calculating according to the duties of at least two regions, i.e., a first region positioned in a border portion of the scanning region as the predetermined region, a control command for determining the scanning direction according to the recording duties of these plurality of regions, and a transmission means for transmitting these control commands.

28. An ink-jet recording apparatus according to any one of claims 17 through 24, wherein the determining means is a means for determining such that the recording is performed in the same direction as the scanning direction in which the recording is previously performed when the recording duty of at least one of the plurality of regions is higher than a previously determined reference value.

29. An ink-jet recording apparatus according to claim 28, wherein, in the determining means, a reference value different from said reference value is set between said plurality of regions.

30. An ink-jet recording apparatus according to claim 29, wherein the reference value of the recording duty in the region in the vicinity of said end portion is set lower.

31. An ink-jet recording apparatus according to any one of claims 17 through 24, wherein the calculation means is a means for performing calculation while sequentially shifting each of said plurality of regions in said scanning region.

32. An ink-jet recording apparatus according to any one of claims 17 through 24, wherein the recording element is a heat generating element ejecting ink droplets by generating changes in the ink condition by using heat energy.

33. An ink-jet recording apparatus according to any one of claims 17 through 24, wherein the recording element is a piezoelectric element ejecting ink droplets by mechanical displacement.

34. An ink-jet recording method according to one of claims 11 through 16, wherein, when the recording duty of at least one of said plurality of regions is higher than a predetermined reference value, recording is performed in the same scanning direction as the previous recording.

35. An ink-jet recording method according to claim 34, wherein there is a difference in the reference value between the plurality of regions.

36. An ink-jet recording method according to claim 35, wherein the reference value of the recording duty in the region in the vicinity of said end portion is set to be lower.

37. An ink-jet recording method according to claim 11, wherein the recording duty obtained through said calculation is the sum total of the recording duties of the different colors.

38. An ink-jet recording method according to claim 11, wherein the recording duty in the predetermined region is the sum total of the recording duties of a specific color.

39. An ink-jet recording method according to any one of claims 11 through 16, wherein the recording duty calculation process is conducted while sequentially shifting each of the plurality of regions in the scanning region.

40. An ink-jet recording method according to any one of claims 11 through 16, wherein the recording element is a heat generating element ejecting ink droplets by causing changes in the ink condition by using heat energy.

41. An ink-jet recording method according to any one of claims 11 through 16, wherein the recording element is a piezoelectric element ejecting ink droplets by mechanical displacement.

42. An ink-jet recording apparatus according to any one of claims 7 through 10, wherein the means for determining the scanning direction is a means for determining the scanning direction according to the duty of image data of at least a secondary color.

43. An ink-jet recording apparatus according to any one of claims 6 through 10, wherein the means for determining the scanning direction is a means for performing recording in the same scanning direction as the recording direction of the previously performed scanning when the recording duty exceeds a predetermined value.

44. An ink-jet recording apparatus according to any one of claims 6 through 10, wherein the means for determining the scanning direction is a means for performing the second scanning onward in the same direction as the first scanning in which a predetermined value is exceeded when the recording duty exceeds a predetermined value in at least two consecutive scanning operations.

45. An ink-jet recording method according to any one of claims 1, 3 or 4, wherein the scanning direction is determined according to the duty of image data of at least a secondary color.

46. An ink-jet recording method according to any one of claims 1 through 5, wherein recording is performed in the same scanning direction as the recording direction of the previously performed scanning when the recording duty exceeds a predetermined value.

47. An ink-jet recording method according to any one of claims 1 through 5, wherein, when the recording duty exceeds a predetermined value in at least two consecutive scanning operations, the scanning from the second scanning onward is performed in the same direction as the first scanning in which the predetermined value is exceeded.

* * * * *

UNITED STATES PATENT AND TRADEMARK OFFICE

CERTIFICATE OF CORRECTION

PATENT NO. : 6,474,779 B2
DATED : November 5, 2002
INVENTOR(S) : Toshiharu Inui et al.

It is certified that error appears in the above-identified patent and that said Letters Patent is hereby corrected as shown below:

Column 1,
Line 42, “and” should be delected.

Column 3,
Line 5, “for” should read -- to --.

Column 9,
Line 34, “cunt” should read -- count --.

Column 11,
Line 44, “than” should be deleted.

Column 18,
Line 3, “1750%” should read -- 175% --;
Line 58, “setting” should read -- setting is --; and
Line 63, “stop” should read -- step --.

Column 19,
Line 58, “he” should read -- the --.

Column 23,
Line 51, “with” should read -- width --.

Column 24,
Lines 23 and 43, “with” should read -- width --.

Signed and Sealed this

Second Day of September, 2003

JAMES E. ROGAN
*Director of the United States Patent and Trademark Office*